US007661457B2

(12) United States Patent
Snyder et al.

(10) Patent No.: US 7,661,457 B2
(45) Date of Patent: Feb. 16, 2010

(54) GAS FLOW CONTROL SYSTEM FOR MOLTEN METAL MOLDS WITH PERMEABLE PERIMETER WALLS

(75) Inventors: Todd Snyder, Logan, UT (US); David Salee, Spokane, WA (US); Steve Anderson, Farmington, WA (US); Brett Thielman, Spokane, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 11/506,751

(22) Filed: Aug. 18, 2006

(65) Prior Publication Data

US 2008/0041553 A1 Feb. 21, 2008

(51) Int. Cl.
*B22D 11/07* (2006.01)

(52) U.S. Cl. ..... 164/472; 164/268

(58) Field of Classification Search ..... 164/475, 164/472, 268, 322

See application file for complete search history.

(56) References Cited

U.S. PATENT DOCUMENTS

| | | | | | |
|---|---|---|---|---|---|
| 3,319,924 | A * | 5/1967 | Wilson | 251/26 |
| 4,450,887 | A * | 5/1984 | Wilkins | 164/449.1 |
| 4,598,763 | A * | 7/1986 | Wagstaff et al. | 164/472 |
| 5,873,405 | A * | 2/1999 | Carrier et al. | 164/472 |
| 6,085,828 | A * | 7/2000 | Wagstaff et al. | 164/449.1 |
| 6,250,521 | B1 * | 6/2001 | Assar | 222/590 |
| 6,425,435 | B1 * | 7/2002 | Macheske et al. | 164/326 |
| 6,609,557 | B1 * | 8/2003 | Anderson | 164/459 |
| 2004/0250982 | A1 * | 12/2004 | Anderson et al. | 164/453 |

* cited by examiner

*Primary Examiner*—Kevin P Kerns
(74) *Attorney, Agent, or Firm*—Wells St. John P.S.

(57) ABSTRACT

A gas flow control system for molten metal molds with permeable perimeter walls, wherein an approximately constant gas mass flow is maintained in individual molds and approximately equal gas mass flows are maintained in molds on the same mold table. A PLC is utilized in combination with a gas mass flow controller to continually monitor and maintain the approximately desired mass flow of gas to the mold cavities.

12 Claims, 20 Drawing Sheets

GAS FLOW CONTROL SYSTEM FOR MOLTEN METAL MOLDS WITH PERMEABLE PERIMETER WALLS

CROSS REFERENCE TO RELATED APPLICATION

This application does not claim priority from any other application.

TECHNICAL FIELD

This invention pertains to a system for providing improved gas flow into molds on a mold table which utilize permeable perimeter walls around the mold outlet in metal casting molds.

BACKGROUND OF THE INVENTION

Metal ingots, billets and other castparts may be formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

Around the mold outlet of some of these molds is a permeable perimeter wall, which in the case of circular diameter castparts, is a circular ring. Any one of a number of different shapes may be utilized in the casting mold, with no one in particular being required to practice this invention. While the permeable perimeter wall is typically made from graphite, it may also be made from other material. The permeability of the perimeter wall allows a gas and/or a lubricant to be forced through the wall and provide a gas force around the mold on the castpart being molded. The gas and the lubricant enhance the molding process and the quality of the castpart.

While the invention applies to the casting of metals in general, including without limitation aluminum, brass, lead, zinc, magnesium, copper, steel, etc., the examples given and preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There, are also mold table carriages which allow the mold table assemblies to be moved to and from the casting position above the casting pit.

FIG. 1 further shows the platen 107 and starting block base 108 partially descended into the casting pit 101 with castpart or billet 113 being partially formed. Ingot 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block typically used when an ingot is being cast and starting head when a billet is being cast.

While the starting block base 108 in FIG. 1 only shows one starting block 108 and pedestal 115, there are typically several of each mounted on each starting block base, which simultaneously cast billets, special shapes or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a pre-determined rate, thereby lowering the ram 106 and consequently the starting block at a pre-determined and controlled rate. The mold is controllably cooled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired shape. There is an air gap between the emerging solidified metal and the permeable ring wall. Below that, there is also a mold air cavity between the emerging solidified metal and the lower portion of the mold and related equipment.

After a particular cast is completed, as described above, the mold table is typically tilted upward and away from the top of the casting pit, as shown in FIG. 1. When the mold table is tilted or pivoted, and without a lubricant control system, the lubricant tends to drain out of the conduits and leaks either into the casting pit or on the floor of the casting facility.

The use of a permeable or porous perimeter wall has proven to be an effective and efficient way to distribute lubricant and gas to the inside surface of a continuous casting mold, one example of which is described in U.S. Pat. No. 4,598,763 to Wagstaff, which is hereby incorporated herein by this reference as though fully set forth herein.

In the typical use of a permeable perimeter wall, lubricant and gas are delivered to the perimeter wall under pressure through grooves or delivery conduits around the perimeter wall, typically using one delivery conduit (if grooves are used for the delivery of lubricant) and one or two delivery conduits (grooves) for the delivery of gas. The preferred lubricants are synthetic oils, whereas the current preferred gas is air. The lubricant and gas then permeate through the perimeter wall and are delivered to the interior of the mold as part of the casting process.

The perimeter walls on existing mold tables each have delivery conduits to deliver the lubricant and/or gas, and the delivery conduits may be circumferential groove-shaped delivery conduits with the same depth and width, or they may be holes partially drilled through the perimeter walls, or any other delivery means for that matter. The typical perimeter wall has a separate lubricant delivery conduit and a gas conduit.

Although embodiments and aspects of this invention are directed to graphite rings, applications of this are not limited to graphite. Graphite has proven to be the preferred permeable material for use as the perimeter wall material or media.

It is desired in some embodiments of this invention to have the same mass flow of gas through each permeable ring on a given mold table. In the typical prior art mold the pressure at which gas was supplied to each ring was generally the same pressure, although the pressure was raised and/or lowered to all permeable perimeter walls before, during and after startup.

No two permeable rings are identical and each allows the passage of gas or gas flow a little differently. Furthermore as the life of a particular permeable ring passes, its permeability decreases due to any one of a number of different factors (clogging, varnishing, or simply the characteristics of that individual permeable ring, etc.).

Prior art pressure based systems which force the gas through the permeable rings generally provide the same pressure gas to all the permeable rings. While it is desirable to achieve the same mass flow rate of gas through each permeable ring on a mold table, the practicalities of the differences in each permeable ring and the rate at which their permeability decreases, creates a situation in which the mass flow rate of gas through the different permeable rings differs or varies. This is especially true if the gas flow supplied to all permeable rings on a mold table is the same. Trying then to achieve approximately equal flow generally requires operator adjustment of the pressure at each mold, which requires operators to spend more time at the casting pit than desired.

Since the inlet pressure for the table provides one pressure for the gas flow, if the pressure valve is manually turned up to increase the flow to the permeable rings which are clogging first, then this also has the undesirable affect of increasing the pressure and consequently the flow to the other permeable rings which are allowing more flow through.

In the prior art, typically on or just before the startup of casting on a given mold table, the pressure regulator would be manually set to a particular pressure, such as sixty pounds per square inch for the entire table. On startup the pressure would be turned up for example to one hundred pounds per square inch, and then after the startup phase, the pressure would be turned back down to seventy or eighty pounds per square inch for the run pressure. It has typically been a pressure based operation for achieving gas flow to the individual molds on a mold table which utilize permeable perimeter walls. This generally required personnel in or around the casting pit.

It is an object of some embodiments of this invention to provide a gas flow system which provides a more uniform gas mass flow rate or gas flow rate through the permeable perimeter walls in the molds on a given mold table.

It is also an objective of some embodiments of this invention to provide a gas mass flow control system which controls the flow of gas to each individual mold on a table more closely and in a more automated fashion, thereby requiring less operator presence at or around the casting pit.

Some embodiments or aspects of this invention provide a mass flow meter which can be positioned outside of the casting pit area if desired. Embodiments of this invention key on the measurement the mass flow of the gas, which results in a more consistent mass flow of gas through each permeable ring and a more equal flow rate to each of the plurality of permeable perimeter walls on a given mold table.

It will also be appreciated by those of ordinary skill in the art how this invention's utilization of a Supervisory Control and Data Acquisition ("SCADA") data logging system which logs critical and non-critical mold operating parameters may be utilized in the overall casting process control and allow for the establishment of set points for one or more of the parameters for better process control and failure prevention. The recording and monitoring of casting gas flows and mold "back-pressure" for instance provides the ability for process improvement and mold condition evaluation. This type of data gathering may be used to provide the operator alarms for any one or more of numerous action items, such as providing an alarm that the mold is ready to be removed from the casting table and replaced.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical, and preferred embodiment being illustrated in the accompanying drawings, as required.

BRIEF DESCRIPTION OF THE DRAWINGS

Preferred embodiments of the invention are described below with reference to the following accompanying drawings.

FIG. 7 is a top view of the permeable perimeter wall illustrated in FIG. 6;

FIG. 10 is a schematic representation of a configuration which may be utilized in some embodiments of the invention for multiple molds;

FIG. 16 shows the typical graph layout as illustrated in FIG. 15, with a flow rate low arm interposed therein;

FIG. 17 shows the typical graph layout as illustrated in FIG. 15, with an out of gas slip condition interposed therein;

FIG. 19 shows the typical graph layout as illustrated in FIG. 15, with a casting oil supply rate too high interposed therein.

DETAILED DESCRIPTION OF THE PREFERRED EMBODIMENTS

Figure 1:
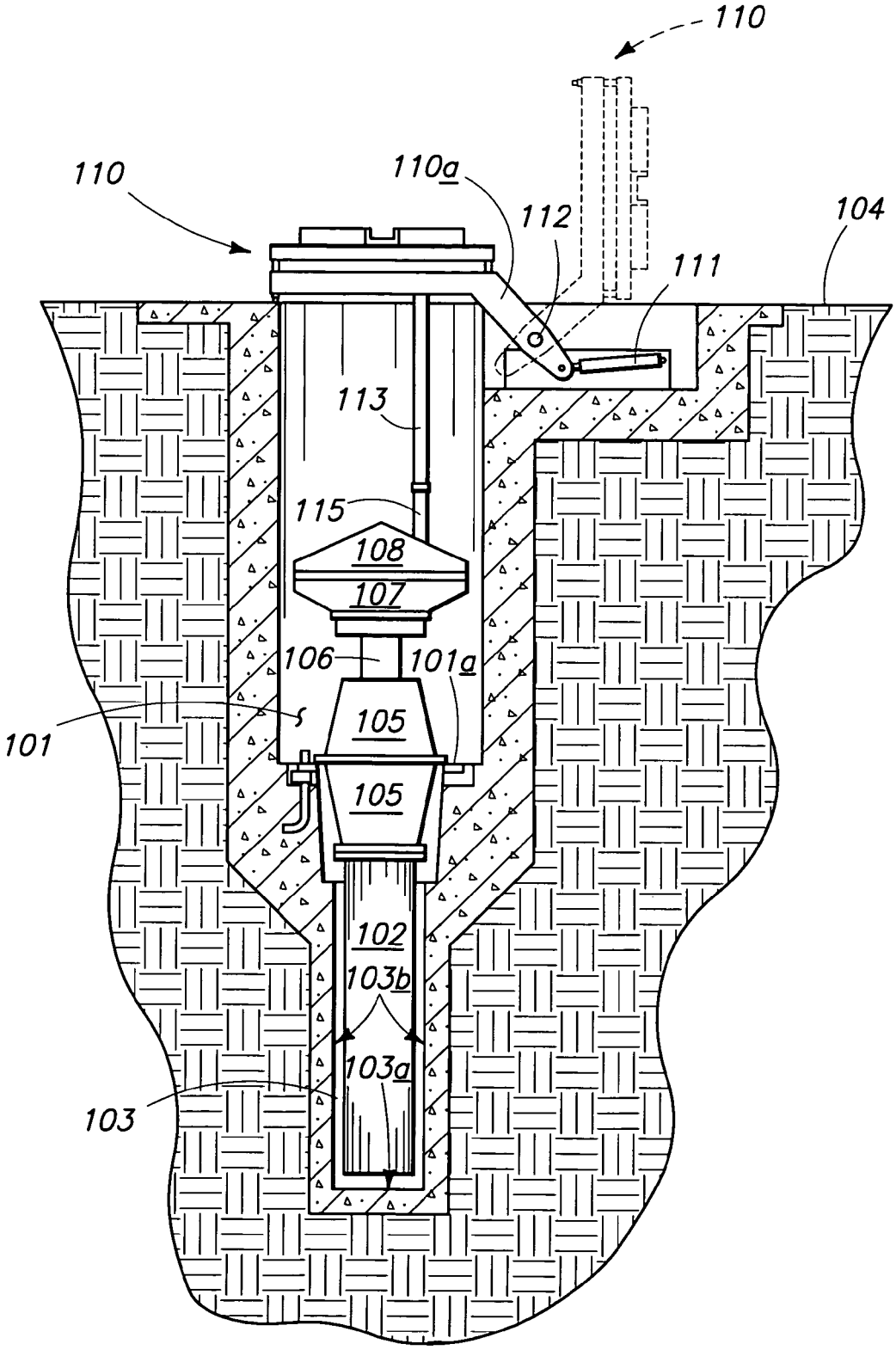
PRIOR ART FIG 1
FIG. 1 is an elevation view of a prior art vertical casting pit, caisson and metal casting apparatus.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The mold therefore must be able to receive molten metal from a source of molten metal, whatever the particular source type is. The mold cavities in the mold must therefore be oriented in fluid or molten metal receiving position relative to the source of molten metal.

It is to be understood that this invention applies to and can be utilized in connection with various types of metal casting and pour technologies and configurations, including but not limited to both hot top technology and conventional pour technology. It is further to be understood that this invention may be used on horizontal or vertical casting devices.

The term around is not limited to being continuous all the way around the object such as the mold cavity, but instead substantially around it. The term circumferential as used herein in reference to the delivery conduits around the perimeter wall, is not limited to a delivery conduit or item which extends around the entire circumference, but instead also includes one which extends partially, but not wholly around the circumference. The delivery conduits may therefore extend around the entire circumference of the perimeter wall.

When the term permeable is used herein with permeable perimeter wall body, the entire perimeter wall body does not necessarily have to be permeable, but instead only that portion through which lubricant and/or gas flow is desired. The term castpart or metal castpart as used herein means any castpart solidified during the casting process with no one in particular being required to practice the invention, including without limitation, rounds, billets, ingots and any one of a number of various other shaped configurations as are known in the trade.

The preferred perimeter walls contemplated by this invention are generally rigid or solid, but they need not be as they may be semi-rigid or semi-solid within the contemplation of this invention. It will also be appreciated by those skilled in the art that the perimeter wall contemplated by this invention may be practiced as a one piece perimeter wall, or a plurality of sections placed together to form the perimeter wall. This will be particularly applicable for special shaped molds.

The term flow rate as used herein in the claims may include not only the actual or measured flow rate, but also the estimated flow rate.

When it is referred to that the perimeter walls are disposed around each mold cavity, that is intended to mean that the perimeter wall is disposed about that part of the mold cavity wherein it may be used, such as is described in U.S. Pat. No. 4,598,763, which has been previously incorporated herein by reference, or in other locations that those skilled in the art will appreciate. This would typically be at an intermediate location or an exit location of the mold cavity, as further illustrated in FIG. 2.

The permeability of a perimeter wall or permeable wall is a function generally of: the material type and quality, where the material is typically graphite; the porosity irregularity within the permeable material; the casting oil viscosity; the casting oil saturation of the casting ring; and the deposits therein, wherein deposits may be for example varnish, polymers, residues, or the like). For each individual mold the permeable material (graphite) and porosity irregularity are generally constant and don't change over time. The oil viscosity and saturation of the perimeter wall are variables that can change during each cast. Oil viscosity decreases with the rise in temperature associated with introduction of liquid metal, and the oil saturation levels are dependent on the oil supply rate and other factors. These short term variables can increase or decrease the permeability of the casting ring. The effects of deposits due to the breakdown of the casting oil are long term factors that gradually decreases the overall permeability of the perimeter wall over time. These deposits are typically the reason perimeter walls fail and are replaced during mold refurbishment.

As will be appreciated, as the permeability of the casting ring decreases, the casting gas supply pressure must increase in order to maintain the same mass gas flow rate.

A desired feature of embodiments of this inventions that the system automatically adjusts the gas pressure to each individual mold to compensate for both short and long term changes to the permeability of the casting ring in order to maintain the desired casting gas flow rate.

If the flow rate were more two dimensional, it would tend to follow Darcey's law more closely, or be easier to apply Darcey's law to it. However, since the flow is necessarily three dimensional, predictions may be made from Darcey's law, but the flow will be generally more difficult to predict. Furthermore, in some applications, the lubricant and the gas may be mixed as it is delivered to the media, in which case the flow rate may further vary from or become less predictable from Darcey's law. The more variance there is from Darcey's law, the more that empirical data will need to be relied upon.

Before getting into specific drawings showing one or more embodiments of the invention, a description of the general components will be given. In some preferred embodiments of the invention the mass flow controller would be mounted at, on or near the mold table and the molds being controlled, and embodiments of the mass flow control enclosure may include: on-board Programmable Logic Controller ("PLC"), an input/output (I/O) and communication controls. The system may but need not utilize known ethernet communication protocols to communicate between the PLC and the IO of the mass flow controllers. The pressure regulator may likewise be located on-board or on the mold table, and the unit may be mounted on the mold table to minimize the tubing runs from the flow controllers to the molds, which reduces pressure drops in the tubing.

Embodiments of the mass flow control enclosure may easily be integrated into existing facilities or installed on certain existing mold tables, and it is preferred that pressurized casting gas, twenty-four vdc power and CAT5 communication cable utility connections be available or provided to better facilitate this invention for a retrofit or for an original installation. The gas flow system will also utilize elements common to casting pit areas, such as a source of pressurized gas (which may for example be provided at one hundred thirty-five psi), preferably filtered (to for example five micron) and dry (for example at minus forty degrees Celsius dew point), and power, which may be at one hundred twenty VAC at fifteen ampere minimum. The source of pressurized gas needs to be above the pre-determined psi of the regulated gas, which is preferably one hundred twenty psi.

The mass flow control enclosure may also include a full protective cover to protect the components from inadvertent metal splashes or other unwanted environmental interference, along with facilitating the internal cooling of the enclosure if that is provided in a given application of the invention.

Another desirable feature of embodiments of the mass flow control enclosure contemplated by this invention is that it may be utilized on or interchangeable with those on other mold tables. So the mass flow control enclosure may be removed from a mold table at which it is operating and be easily utilized on other mold tables, or removed for other reasons.

This invention further utilizes a mass flow controller instead of purely a master pressure controller, to vary the delivery of gas to each of the mold cavity outlets. It will be appreciated by those of ordinary skill in the art that this will reduce or eliminate the error associated with the effects that the prior art experiences in merely varying gas pressures. It is believed and will be appreciated that this will increase the life of the permeable perimeter walls, which may be graphite casting rings, by allowing the system to operate at a higher pressure than prior art systems. This will also allow this control system to more effectively provide gas through the less porous or less permeable perimeter walls at any stage in the process, including after their permeability has diminished during casting. Those of ordinary skill in the art will recognize the operational and economic benefit to allowing the system to maintain proper consistent casting gas (mass) flows as the permeable walls become plugged and how this will reduce the consumables costs for molding with permeable walls such as graphite rings.

It will also be appreciated by those of ordinary skill in the art how embodiments of this system substantially eliminates the need for individual operator mold gas flow rate adjustment as the system automatically adjusts the casting gas flow rate for each mold to the proper settings, which increases the gas flow uniformity from mold to mold, cast after cast.

With the data collection and storage capabilities of this invention, the system can establish optimal or preferred settings or gas flow rates based specifically on that mold's characteristics. For instance if during a first cast it is determined that a particular mold operates more preferable at a particular gas flow rate in order to optimize the billet surface for example, this variance in the flow characteristics may be electronically stored in the programmable logic controller and those same parameters implemented in subsequent castings. These settings may also be reset if the particular target mold is removed from the table and replaced with a new mold.

Embodiments of this invention also allow flow rate adjustments either from the mold table operator control panel or with the use of a wireless portable devices that may be carried around the casting pit area for direct observation of the billets as they are cast, such as a tablet interface. The tablet interface will provide an additional way of communicating desired commands and system changes to the PLC for implementation in the gas flow control system.

It will be appreciated by those of ordinary skill in the art from the invention as described, that gas flow rate change may be made globally to the plurality of molds on a mold table, or independently to specific molds. With the ability to control the gas flow to each individual mold, this invention provides the further configuration which allows it to store or maintain the set-point gas flow rates for each mold independently, and which allows for the automatic compensation for varying conditions within the permeable wall from cast to cast.

It is generally desirable in existing systems to initially use a given pressure, say forty-five psi when filling the troughs with molten metal, with the goal being to have the same mass flow through each mold. When the mold table is lowered, the gas pressure is turned up to about one hundred psi, with the additional pressure being utilized for among other things, to reduce the oxide layer off the metal which may keep the castpart from flowing easily. After the castpart platform has been lowered about eight to twelve inches, the gas pressure is normally preferably reduced to about sixty or seventy psi for its "run pressure", a desirable pressure at which to run the casting process. In typical casting tables with permeable walls, the fill pressure may therefore be about forty-five psi, the start pressure at about one hundred psi and the run pressure at about seventy psi. However, these prior systems are not as focused on mass flow as is desired and mass flow generally involves a separate or independent measurement or calculation from other measurements.

FIG. 1 is an elevation view of a typical prior art vertical casting pit, caisson and metal casting apparatus, and is described in more detail above.

Figure 2:
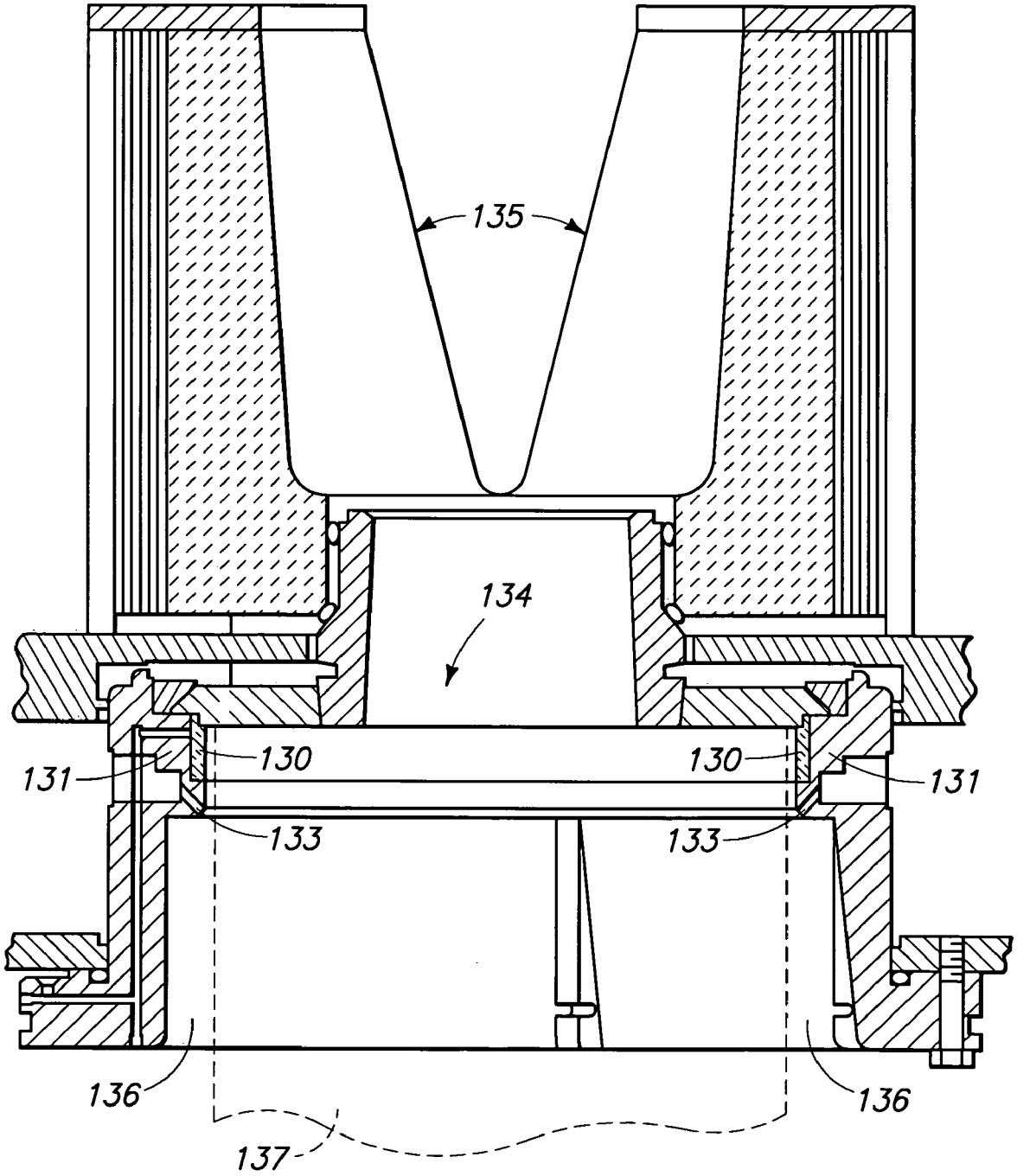
PRIOR ART FIG 2
FIG. 2 is a cross sectional elevation view of a typical prior art mold casting assembly, illustrating the perimeter wall in place.

FIG. 2 illustrates a prior art perimeter wall 130 in place in a mold, and abutted against the mold housing 131. The mold housing 131 combined with the lubricant and gas delivery conduits in the perimeter wall form the lubricant and gas passageways through which the lubricant and gas are provided to permeate through the perimeter wall 130. Coolant is introduced to solidify the emerging metal through coolant passageways 133.

FIG. 2 further illustrates the mold inlet 134, the refractory troughs 135 for directing the molten metal to the mold inlet 134. The embodiment in FIG. 2 illustrates an emerging solidified billet 137, and the mold air cavity 136 surrounding the billet 137.

It should be noted that the air cavity 136 is different than what is referred to in the industry as the air gap or air slip. The air gap or air slip is the layer or area of air which occurs between the perimeter wall 130 and the metal passing through the perimeter wall 130 during casting.

Figure 3:
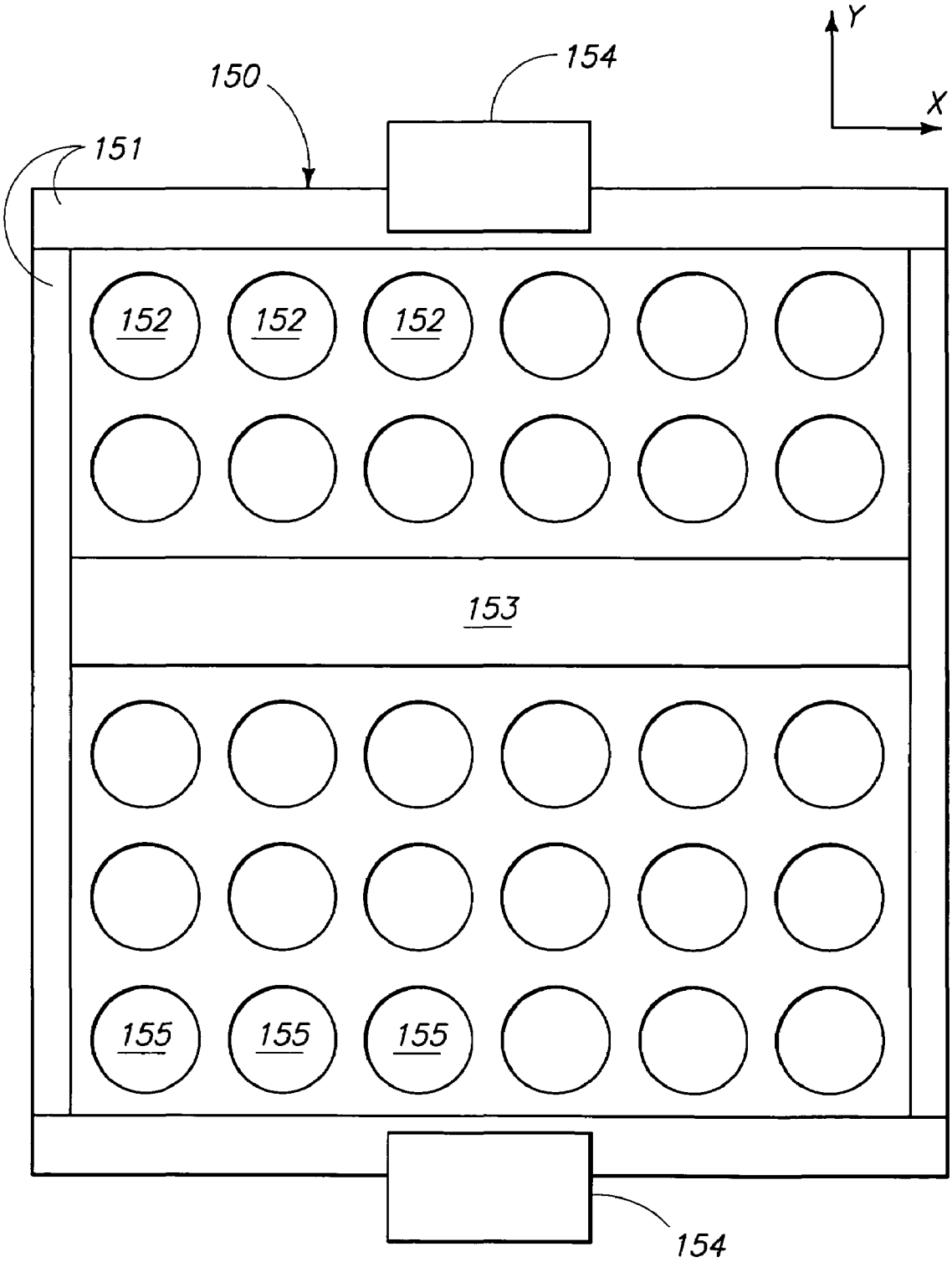
FIG. 3 is a top schematic view of an illustrative mold table configuration with multiple molds.

FIG. 3 is a top schematic view of an illustrative mold table 150 configuration with multiple molds, on which this invention may be utilized. FIG. 3 illustrates mold table framework 151, center trough 153 dividing a first plurality of molds 152 and a second plurality of molds 155. While the two gas flow control enclosures 154 are located at two ends of the mold table 150, it will be appreciated that one or more gas flow control enclosures 154 may be utilized and may be located in any one of a number of locations, with no one in particular being required to practice this invention.

Figure 4:
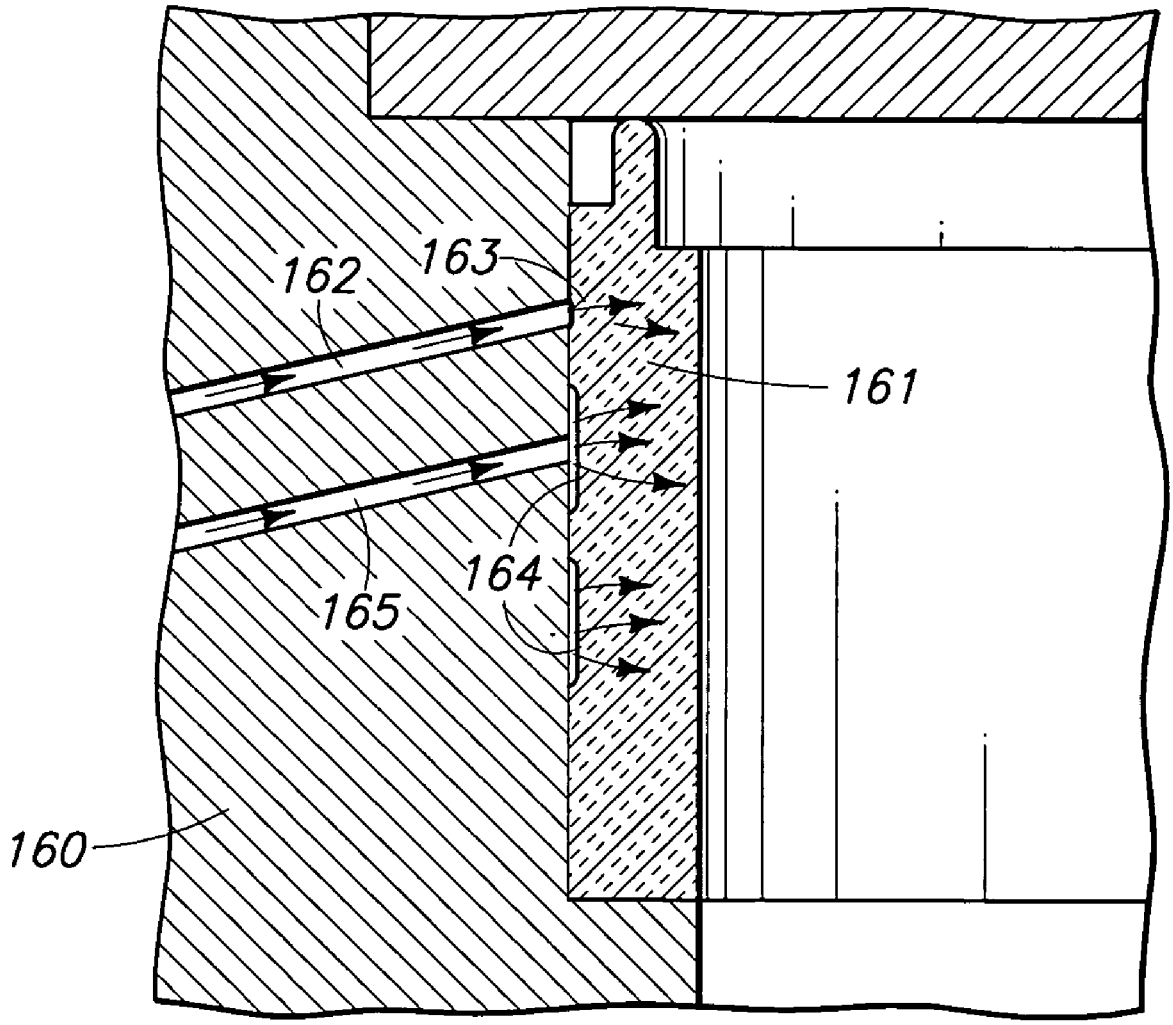
FIG. 4 is a cross sectional view of a permeable perimeter wall, which may be a graphite ring, seated in a mold housing, illustrating the flow of lubricant and/or gas through its body.

FIG. 4 is a cross sectional view of a permeable perimeter wall 161, which may be a graphite ring, seated in a mold housing 160, illustrating the flow of lubricant and/or gas through its body. The gas inlet line 165 through mold housing 160, and arrows 164 are indicative of gas permeating through the perimeter wall 161 and into the mold cavity. FIG. 4 also shows an exemplary lubrication line 162 with arrows 163 illustrating that lubricant is flowing through the line, through the permeable perimeter wall 161 and into the mold cavity.

Figure 5:
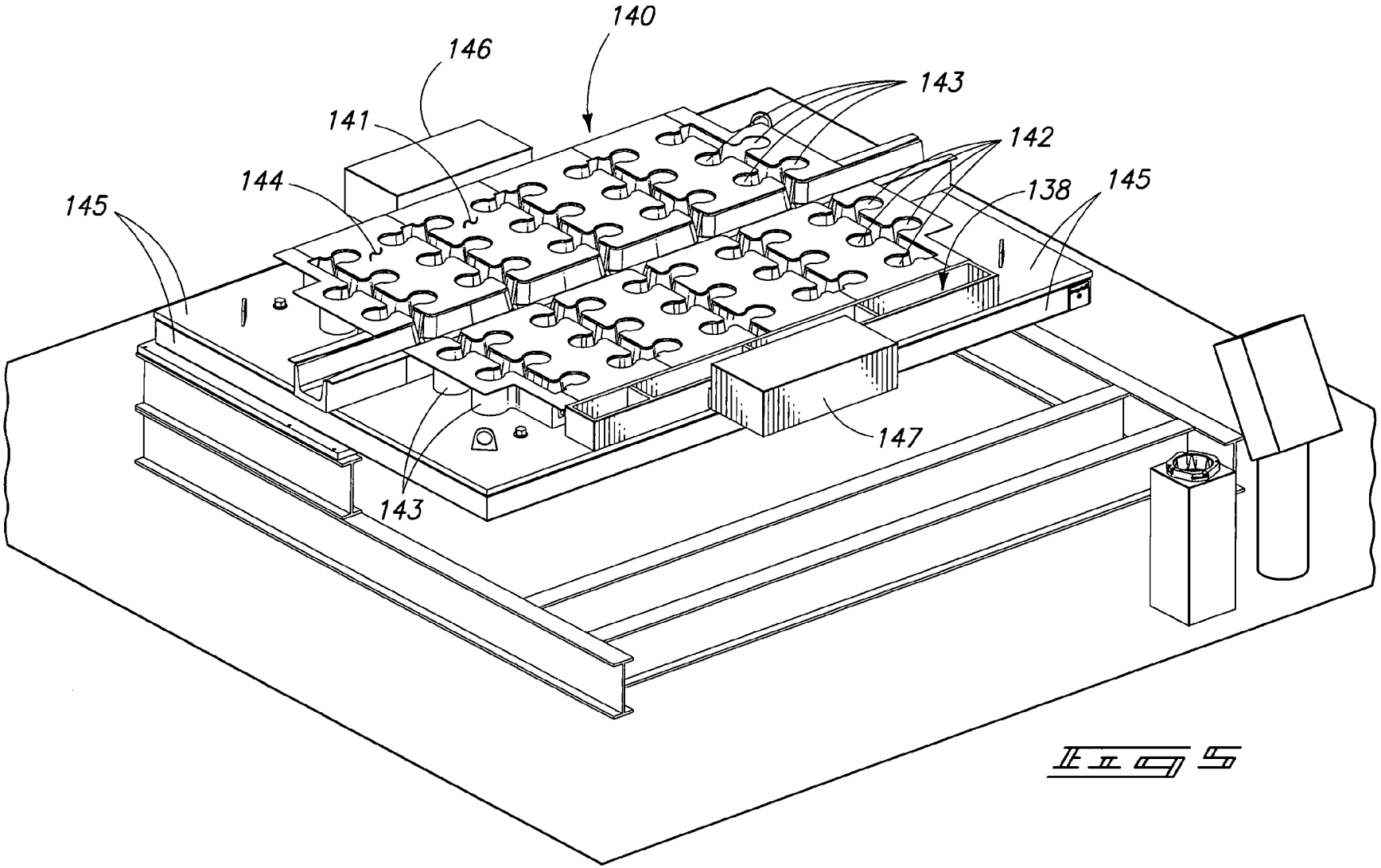
FIG. 5 is a perspective elevation view of a mold table on which embodiments of this invention may be utilized.

FIG. 5 is a perspective elevation view of a mold table 140 on which embodiments of this invention may be utilized, illustrating mold table framework 145, center trough 141, a plurality of mold inlets 143 on a first side of the mold table 140, and a plurality of mold inlets 142 on a second side of the mold table 140. Troughs 143 are generally comprised of a refractory material, which includes a top 144, which is typically made of a metallic material.

Two mass flow control enclosures 146 and 147 are also shown in FIG. 5, with first mass flow control enclosure 146 shown at the first end of the mold table 140 and second mass flow control enclosure 147 shown at the second side of mold table 140.

FIG. 5 combined with other figures further illustrates the modularity of the mass flow control enclosures 147 and how they can be interfaced and operatively connected to a given mold table via a connection manifold and then relatively easily removed to and utilized at another mold table.

Figure 6:
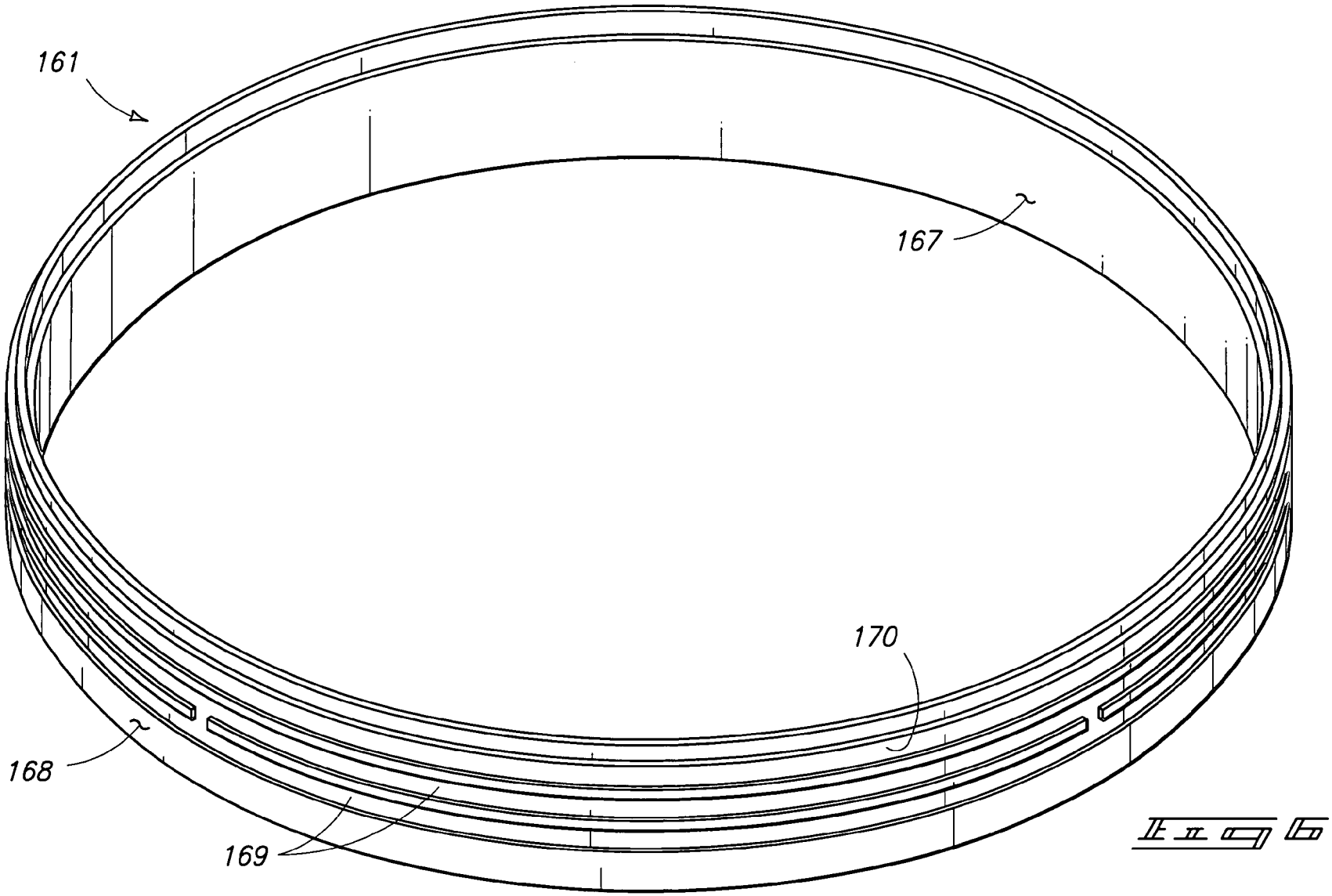
FIG. 6 is a perspective view of one example of a permeable perimeter wall which may be used in embodiments of this invention.

FIG. 6 is a perspective view of one example of a permeable perimeter wall 161 which may be used in embodiments of this invention, and illustrates the inner surface 167, the outer surface 168, gas delivery conduits 169 and lubricant delivery conduit 170. The two gas delivery conduits 169 are shown in operative communication or connection to one another.

FIG. 7 is a top view of the permeable perimeter wall 161 illustrated in FIG. 6, showing the inner surface 167 which is at part of the mold and the outer surface 168.

Figure 8:
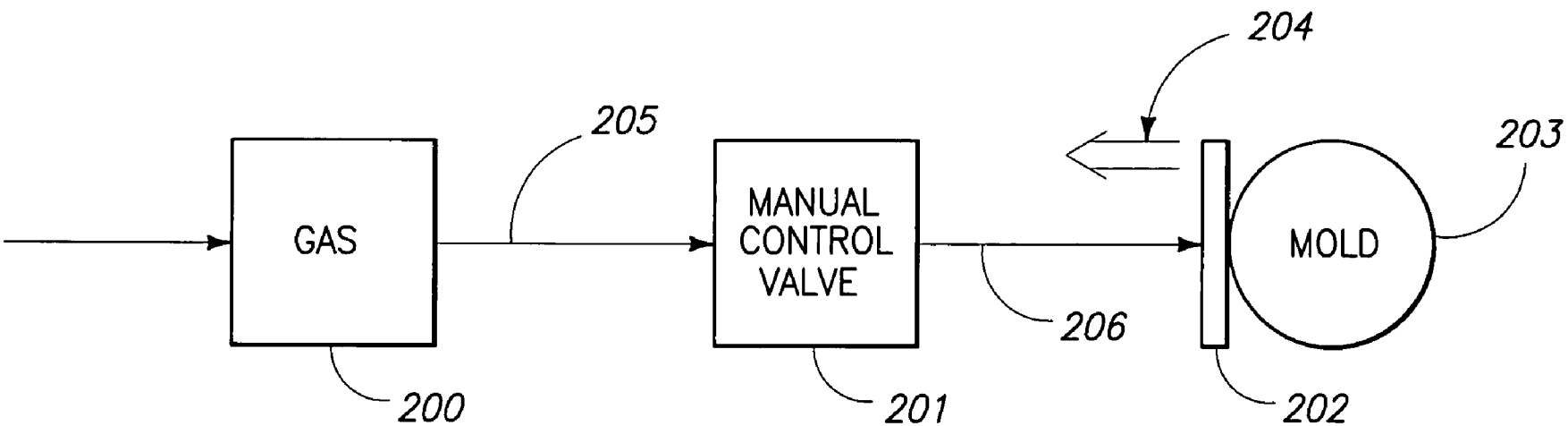
PRIOR ART FIG 8
FIG. 8 is a schematic of a prior art system illustrating the manual control valve and how back-pressure results from the permeable perimeter ring.

FIG. 8 is a schematic of a prior art system illustrating the manual control valve 201 and how back-pressure 204 results from the permeable perimeter wall or ring 202. FIG. 8 shows input or supply gas 200 operatively connected to a manual control valve 201 via gas line 205, and the control valve operatively connected via gas line 206 to permeable wall 202. Gas passing through permeable wall 202 enters mold 203. The back-pressure 204 is presented by the permeable wall 202 and generally increases with the use of the permeable wall 202, as discussed more fully above.

Figure 9:
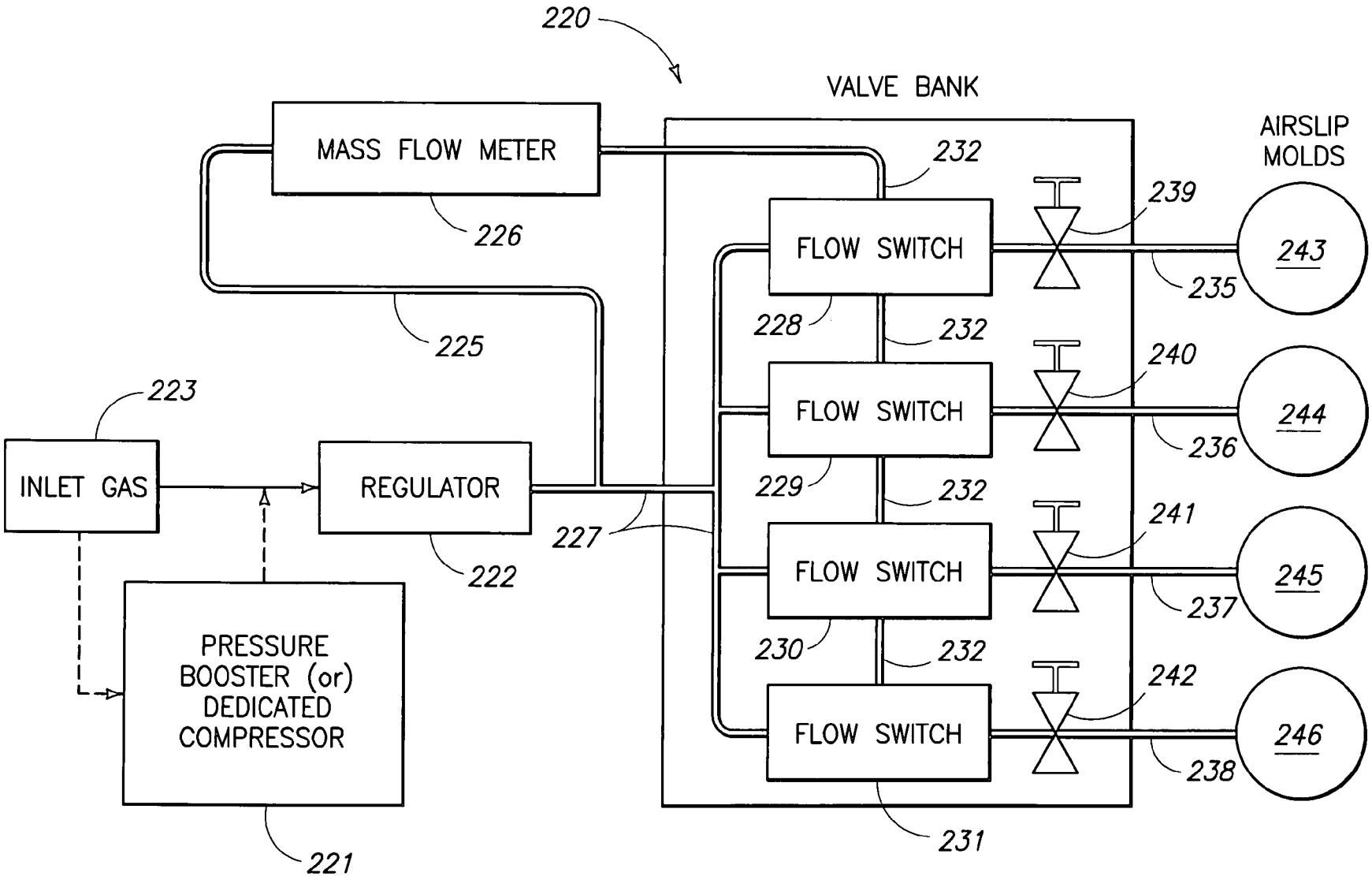
FIG. 9 is a schematic representation of a manual gas flow system configuration for multiple molds on a mold table.
Figure 11:
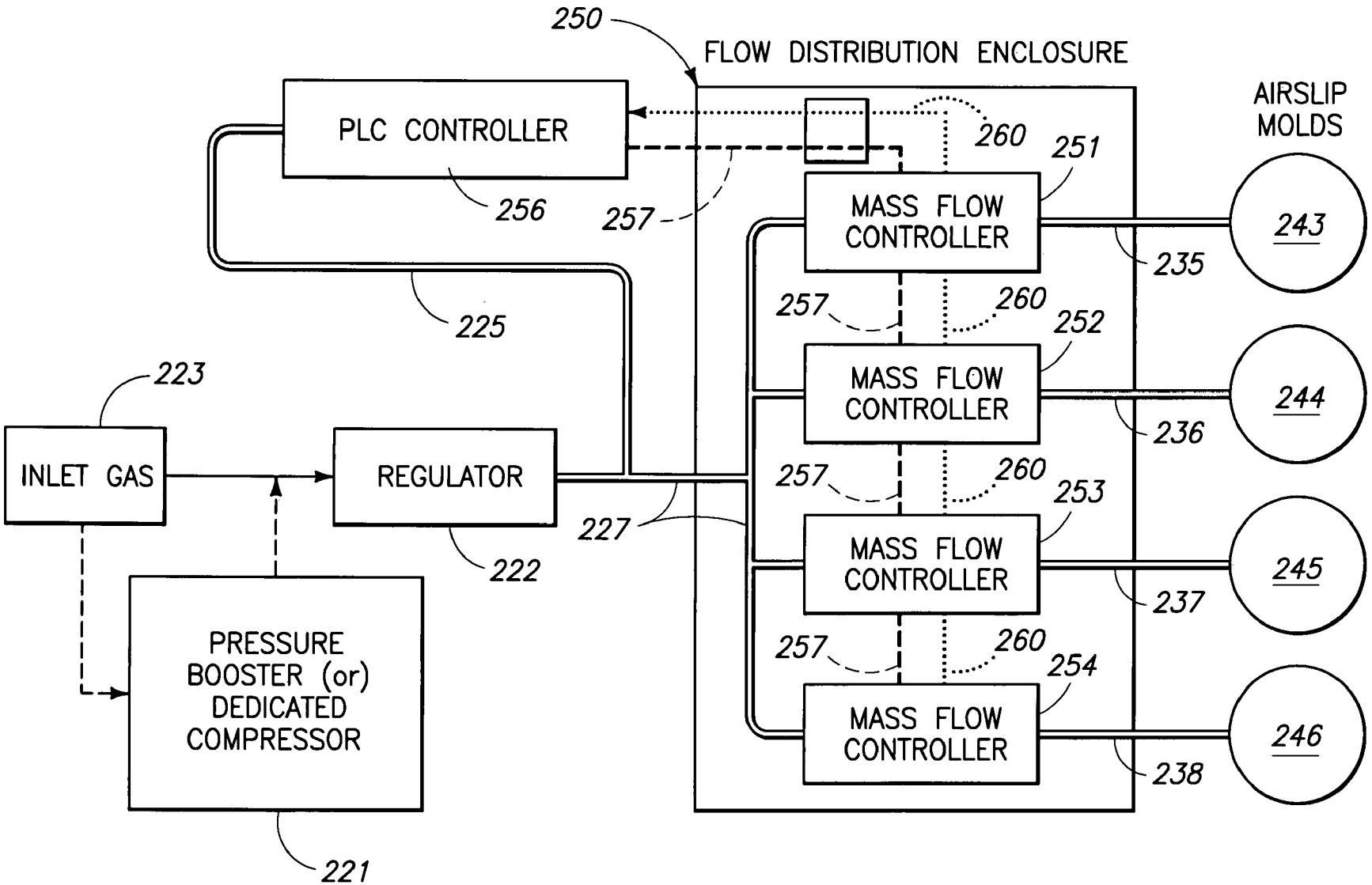
Figure 11:
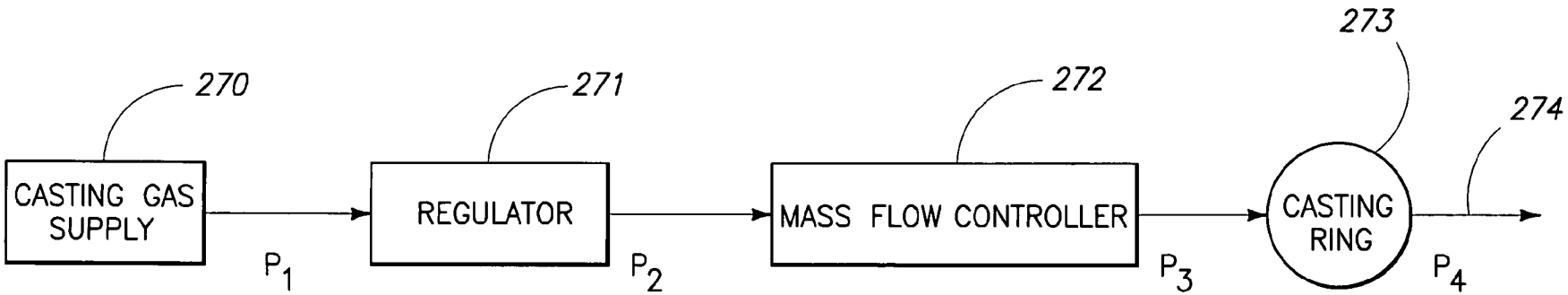

FIG. 9 is a schematic representation of a gas flow system configuration for multiple molds on a mold table. FIG. 9 shows valve bank 220 including a plurality of flow switches 228, 229, 230 and 231, and a plurality of air valves 239, 240, 241 and 242. The plurality of manual air valves 239, 240, 241 and 242 are valves which may be manually adjusted to varying pressures to allow the changing of the pressure of the gas flow at different stages in the casting process or in response to negative characteristics which may be observed on castparts made by that particular mold. FIG. 9 shows inlet gas source 223 operatively connected to a pressure booster 221 if needed and air pressure regulator 222, which regulates the input gas pressure to provide the desired gas flow pressure. This may be set for example be about one hundred twenty psi. Mass flow meter 226 is operatively connected to air pressure regulator via line 225 and also operatively connected to flow switches 228, 229, 230 and 231 via line 232.

FIG. 9 illustrates a plurality of flow switches 228, 229, 230 and 231, each operatively connected to a plurality of molds 243, 244, 245 and 246 respectively, by communication lines or communication channels 235, 236, 237 and 238 respectively. FIG. 9 also shows how air pressure regulator may be operatively connected via gas line 227 to the plurality of flow switches 228, 229, 230 and 231. The flow switches 228, 229, 230 and 231 may for instance be one or more on-off valves such as poppet valves that are controlled to appropriately turn on and off the flow of gas, whereas proportional valves 239, 240, 241 and 242 may be utilized to add additional back-pressure to a given line or mold to strive toward equal back-pressure in the gas flow lines to each mold on a mold table.

FIG. 10 is a schematic representation of a configuration which may be utilized in some embodiments of the invention for multiple molds. FIG. 10 shows inlet gas source 223 operatively connected to a pressure booster 221 if needed and air pressure regulator 222, which regulates the input gas pressure to provide the desire gas flow pressure. This may be set for example be about one hundred twenty psi. Air pressure regulator 222 is operatively connected via gas lines 227 to mass flow controllers 251, 252, 253 and 254, providing gas thereto. Flow distribution enclosure 250 is also shown in FIG. 10.

PLC 256 is operatively connected to air pressure regulator 222 via line 225, and also operatively connected to mass flow controllers 251, 252, 253 and 254 via communication channels or lines 257 and 260, with channel 260 being the feedback loop. It will be appreciated by those of ordinary skill in the art that the lines or communication channels referred to herein may be any one of a number of different types of hard wire connectors, optic connectors, ethernet-based, or even a wireless channel, all within the contemplation of this invention and no one required to practice this invention. PLC input/output (IO) may be utilized to provide the input/output interface between the PLC and the mass flow controllers, among other components.

The use of one PLC 256 to control a plurality of mass flow controllers or mass flow control devices, provides a more economical system since individual PLC's or other devices do not have to be utilized for the control of the gas flow system for each mold. This is accomplished by operatively connecting the PLC 256 to each of the mass flow controllers 251, 252, 253 and 254 such that the PLC can strobe or check the first mass flow controller 251 for relevant parameters, complete that check, then strobe or connect with the second mass flow controller 252, and so on. With the speed of PLC's, the strobing or control of a plurality of mass flow controllers (each controlling the gas flow to one mold), may be accomplished serially in a matter of seconds. This provides a more economical system from a hardware perspective, while still maintaining the desired control over each the mass flow of gas to each mold individually.

FIG. 10 further illustrates a plurality of mass flow controllers 251, 252, 253 and 254 each operatively connected to a plurality of molds 243, 244, 245 and 246 respectively, by gas lines 235, 236, 237 and 238 respectively.

It will be appreciated by those of ordinary skill in the art that different kinds or types of mass flow controllers may be utilized within the contemplation of this embodiment of the invention. For instance a dedicated mass flow controller which specifically and accurately measures the mass flow of the gas may be utilized. Another mass flow controller which may be utilized in embodiments of this invention is one which calculates or arrives at the mass flow rate based on data such as the back-pressure from the permeable wall or graphite ring. Again however, other ways of determining the mass flow of the gas may be utilized within the scope of this invention, such as a mass flow instrument.

A mass flow controller which determines and controls mass flows based on back-pressure may be gas flow controllers which includes components made by Proportionair.

In such an application or embodiment, the mass flow controllers 251, 252, 253 and 254 may each include a mass flow meter, a proportion valve allowing for variable adjustment of pressure, one or more poppet valves (on-off valves) and a pressure or back-pressure gauge. The mass flow controllers 251, 252, 253 and 254 would be operatively connected to a PLC 256 by ethernet or other connections from an electronic perspective. The mass flow controllers 251, 252, 253 and 254 would be operatively connected from a gas flow or gas supply perspective, to regulator 222 which provides a source the source of gas or air at a pre-determined pressure.

In one of the aspects of embodiments of the invention, the back-pressure of each of the permeable walls in the molds may be determined at any given time in its useful life. Again, the back-pressure created by a particular permeable wall will change with the life of the permeable wall, which needs to be considered and adjusted to in order to maintain a desired equal mass flow of gas to each mold on a mold table.

Before metal is distributed for casting or cooling, the gas flow system on a mold table may be started up to a predetermined gas flow, such as fifteen cubic feet per hour (cfh) for example. During this exercise of the system, the inlet gas pressure from the gas pressure regulator is known (preferably about one hundred twenty pounds per square inch), and the primary or sole creator of back-pressure in the gas flow system is the permeable wall or graphite ring in this application. The gas pressure or back-pressure can be measured upstream of the permeable wall, with the difference being the pressure drop or back-pressure created by the flow resistance created as the gas passes through the permeable wall. This type of testing or exercising of the plurality of gas lines can more simply and reliably provide the necessary information to arrive at more uniform gas flow rates throughout the plurality of molds on a given mold table based.

In one application of this embodiment which measures the back-pressure in order to maintain equal flow through all the molds, the mass flow controller may also include or utilize a proportional valve in order to introduce resistance or back-pressure in addition to that presented by the individual permeable walls in order achieve and/or maintain a consistent or equal gas mass flow rate through the permeable walls or graphite rings on each of the molds. For instance if the permeable wall back-pressure provided by the permeable wall graphite ring on one mold is less than the others, the mass flow controller may adjust a variable pressure valve in the line to add pressure so that the total back-pressure (from the combination of the permeable wall and the proportional valve combined) is equal to a pre-determined amount and approximately equal to the back-pressure in the other gas lines for other molds on the table. The graphite ring on a first mold for instance may present a lesser back-pressure than the graphite ring on a second mold and the variable valve or proportional valve can then be automatically set to make up the difference to make the back-pressure through that gas line the same or approximately the same for each of the first and second molds on that table. This may be utilized throughout the entire mold table and each of the mass flow controllers may be controlled by one PLC.

In an embodiment as described in the preceding paragraph, a mass flow controller for a single gas line to a mold on a mold table may utilize various components, such as a proportional valve, a back-pressure gauge or meter, and on-off valves (which may be poppet valves). This combination, as controlled from a single master PLC, would provide a gas flow system which can be controlled remotely and provide an approximately equal mass flow of gas to each of the molds on a mold table.

Another of the alternatives for a mass flow controller for the gas flow would be a sufficiently accurate mass flow meter which actually measures the molecules or mass of gas passing through it, providing a value which can be utilized in combination with the mass flow values in lines connected to other molds, such that a mass flow device may be utilized to make the mass flow rates to each mold on a mold table relatively equal.

Configuring the system as shown in FIG. 10 for example, minimizes the pressure drop through the entire gas flow channels or gas lines and back-pressure operational ranges. An advantageous aspect of embodiments of this invention is the ability to place most of the components of the system "on board" the mold table, one example is as illustrated between FIG. 5 and FIG. 10, with all but the PLC controller being preferably placed on or at the mold table.

Figure 11:
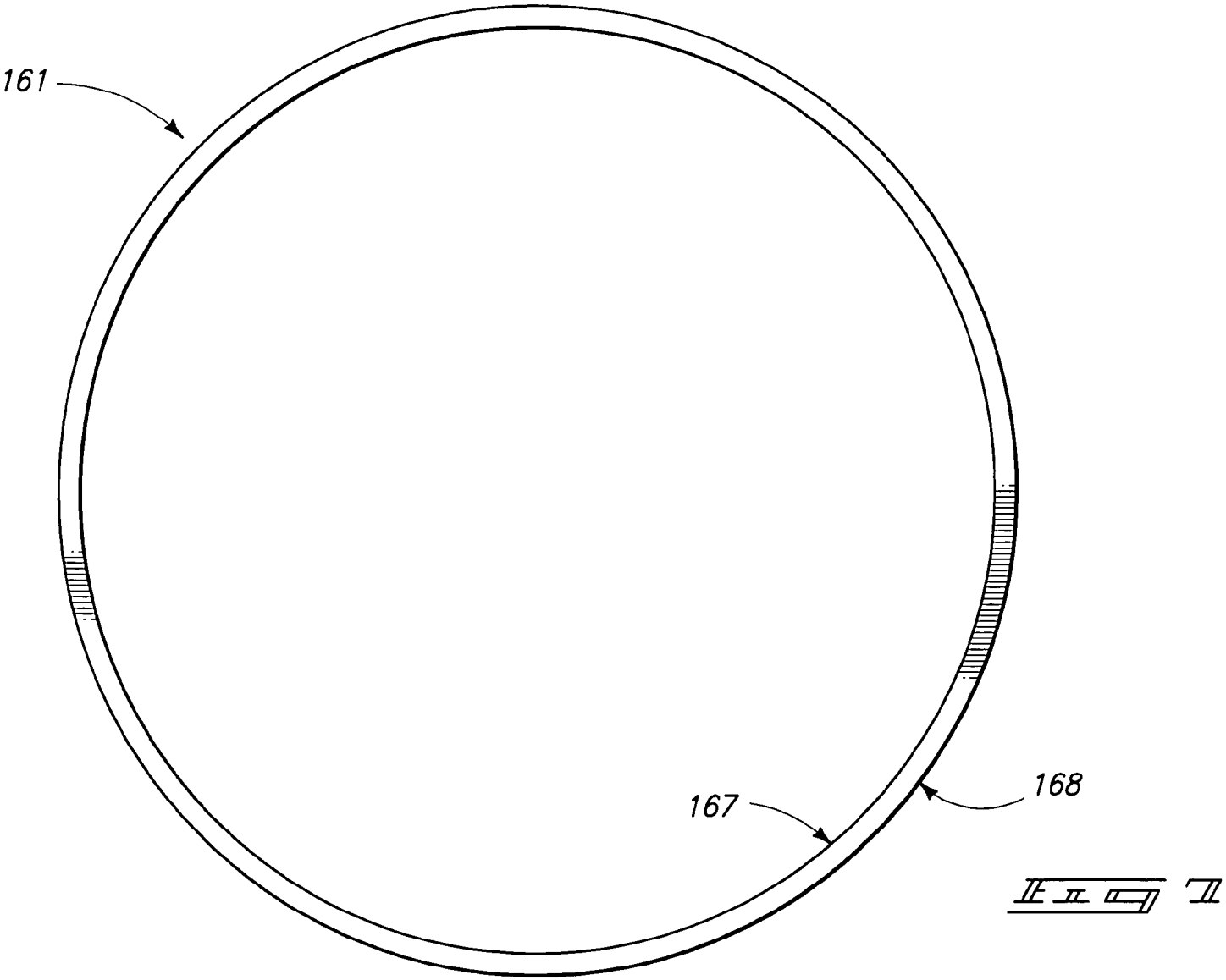
FIG. 11 is a schematic representation of one embodiment of the invention wherein the mass flow controller may utilize measurable pressure data to establish equal mass flow through a plurality of molds on a mold table.

FIG. 11 is a schematic representation of one embodiment of the invention wherein the mass flow controller may utilize measurable pressure data to establish equal mass flow through a plurality of molds on a mold table. An exemplary process for controlling mass flow is also described above with respect to FIG. 10. FIG. 11 shows the source of gas or casting gas supply 270, gas regulator 271, mass flow controller 272, casting ring or permeable perimeter wall 273 and the flow of gas toward the interior of the mold cavity as represented by arrow 274. P1 is the gas supply pressure which is typically preferred to be above one hundred twenty psi so that P2 may be regulated to about one hundred twenty psi; P2 is the regulated or controlled gas pressure, which is generally to be maintained at approximately one hundred twenty psi; P3 is the pressure required to push a given gas flow rate, or mass flow rate, through the permeable perimeter wall, which may be referred to as the back-pressure; and P4 is the exit pressure of the gas as it enters the mold cavity and interacts with the solidifying molten metal during casting. P3 is taken upstream from the permeable perimeter wall.

The differential pressure across the casting ring is equal to P3 minus P4. The formula for Darcey's law provides insight into the flow through the permeable perimeter wall: $q=[kA(P3-P4)]/uL$; wherein q is the flow rate, k is the permeability of the porous media, A is the cross-sectional area of porous media, u is the viscosity of the liquid (which in this case is a gas), L is the length or the thickness through the porous media, P3 is the pressure at the inlet or entry to the perimeter wall and P4 is the exit pressure of the gas after it has proceeded through the perimeter wall or casting ring in this example.

It is desirable to gather data of the back-pressure or P3, which will generally increase over time as the permeable wall gradually begins to plug, varnish begins to develop, or any one of a number of different occurrences reduce the permeability of the perimeter wall. Under the current state of technology, the first sign of a problem with a permeable wall or mold ring is that a poor quality castpart is produced or quality issues develop, which requires unscheduled maintenance and scrapping castparts produced. Embodiments of this invention will allow the collection and analysis of data such as back-pressure (P3) which will in turn allow operators of this control system to pro-actively project when particular molds may need to be taken out of service due to the increase in their back-pressure, before a defective castpart is produced and needs to be scrapped.

Figure 12:
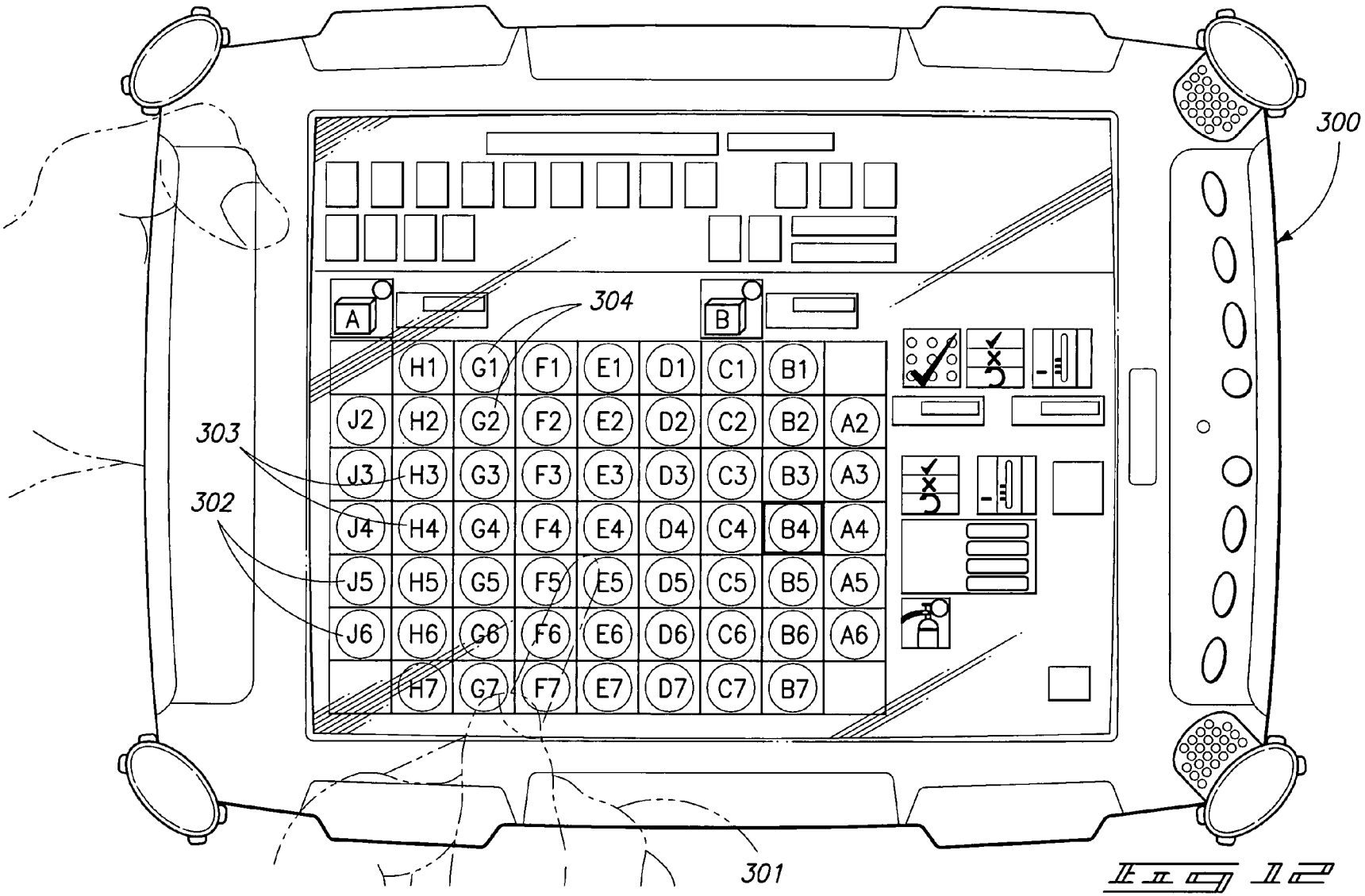
FIG. 12 is an illustration of a table personal computer which may be utilized in embodiments of this invention.

FIG. 12 is an illustration of a tablet computer interface 300 which may be utilized in embodiments of this invention. Tablet computer interfaces 300 such as the one shown for illustration purposes are well known in the art and readily available from multiple sources, and will not therefore be described in detail. FIG. 12 show a user 301 identifying a mold to monitor, review or alter, with the columns and rows of molds being represented or referenced in an alphanumeric manner. FIG. 12 shows for instance column J with molds J2 through J6 representing molds, and the touch screen allowing a particular mold to be selected. FIG. 12 shows column J key spots or touch-spots 302 on the screen, column H touch-spots 303 and column G touch-spots 304. The display of the table computer interface 300 may be customized per the mold table operator's desires. The tablet may be used in various ways, such as to intervene in the operation by for instance providing instructions to the PLC to make appropriate changes to the operation of the mold or the gas flow to the mold.

In some embodiments of the invention, a tablet may be utilized for mobile adjustment of casting gas flow rates. In one aspect of the integration of this invention into or with mold tables, a stand-alone mass flow control automated control system may be provided, and it may include its own separate PLC with a control program and may also include SCADA components. Other embodiments of this invention may additionally be operatively connected to existing casting systems controls for parameter interchange between the gas flow control system and other key casting systems. Embodiments such as this may also include a separate PLC enclosure with power supplies, wireless router, and a tablet PC docking station.

In another aspect of this invention, embodiments or applications of this invention may utilize the existing PLC and casting control system at the mold facility and revised the existing casting program to include mass flow control features. New view screens for mass flow control may be added utilizing a wireless table interface as one example (which would likely include SCADA). The operator control screens already utilized in the mold control and casting process may be revised to include mass flow control panels or views. The wireless router and the tablet docking station options, if utilized, may be integrated into the existing casting control panels, which would allow for a smaller mass flow control enclosure if desired.

Embodiments of this invention now allow for the molds to be adjusted to a precise casting gas mass flow rate; and mass flow is the true quantitative value of flow, unaffected by the effects of changing pressures in the system from whatever cause. It will be appreciated by those of ordinary skill in the art how embodiments of this invention also provide for improved uniformity of gas flows to all molds as the reading is unaffected by the condition or permeability of the casting ring.

Embodiments of this invention also have an additional feature, namely the ability to sequentially strobe or communicate with each individual flow control module to send command signals and receive data feedback. This means that instead of having a separate PLC type control for each mold, the master controller or PLC continually or intermittently sends a signal to each one of the modules, receives the data and then moves on to the next one. This allows individual control of mass flow controllers using only one PLC. The PLC may make separate contact with each mass flow controller every one-quarter to two seconds for example to continually make updates and adjustments. This greatly minimizes the PLC input/output (I/O) requirements, which provides some space and expense savings.

Embodiments of this invention also provide for more custom process routines accomplished through programming code, such as shock routines, gas flow rate offsets, mold gas flow rate verification routines and/or auto-generating program configuration codes.

Figure 13:
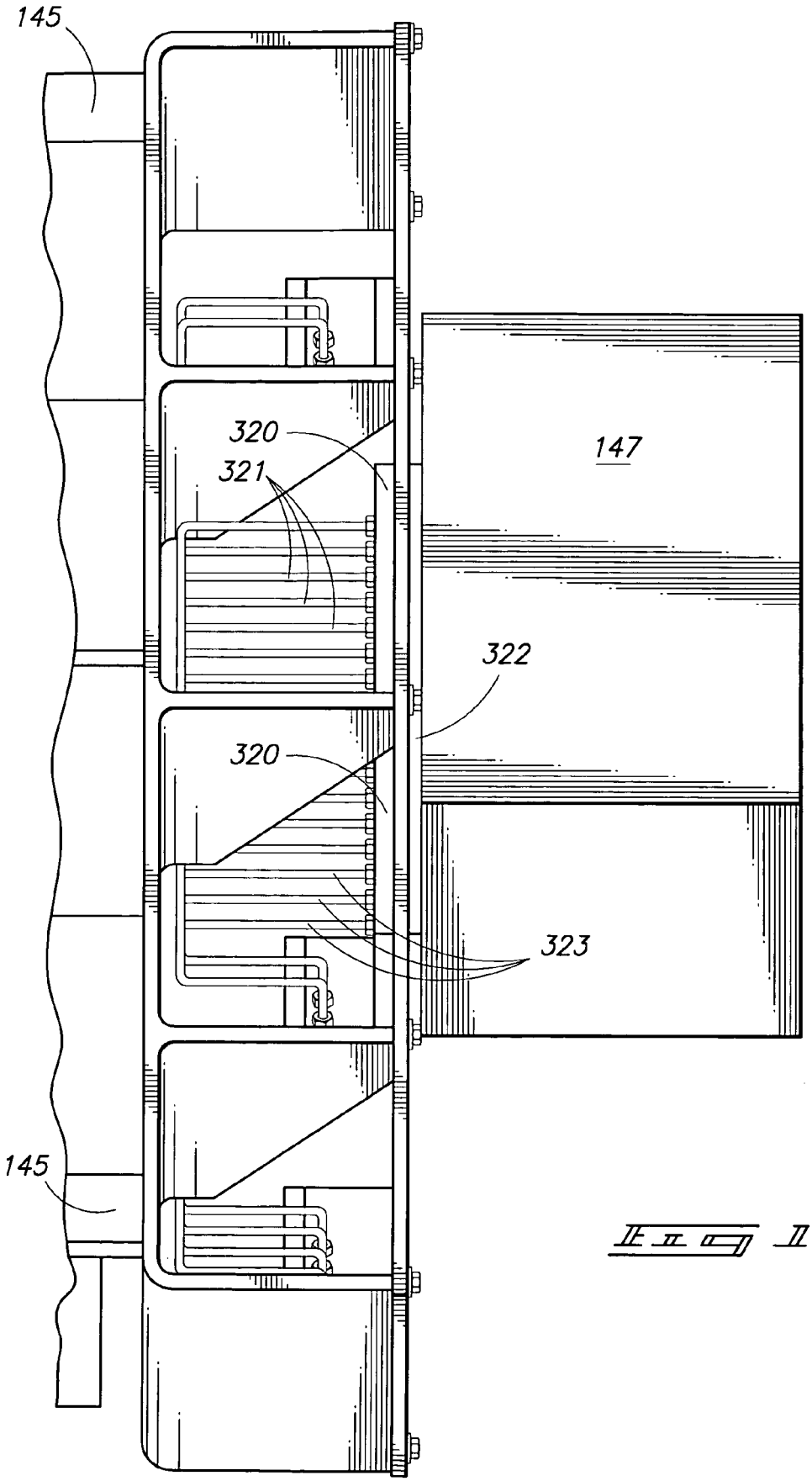
FIG. 13 is a top view of an example of a fluid handling enclosure on a mold table, with a mass flow control enclosure mounted relative thereto.

FIG. 13 is a top view of an example of a fluid handling enclosure on a mold table, with a mass flow control enclosure mounted relative thereto. FIG. 13 shows mold table 145, mass flow control enclosure 147 interconnected or operatively connected to mold table 145 via manifold or interface 322. Gas flow lines 321 and 323 are attached to manifold 320 for location and connection to the mass flow control enclosure 147 via interface 322. One such enclosure may be located as shown by item 138 in FIG. 5. FIG. 13 helps illustrate how in embodiments of this invention, the individual flow control modules or enclosures may be "manifold" or group mounted in order to minimize the amount of tubing connections required for a given table, as shown in FIG. 13. The tubing connects at another end to the molds. This configuration at each mold table may serve to reduce the possibility of system leaks and reduces the overall size of the complete assembly.

Figure 14:
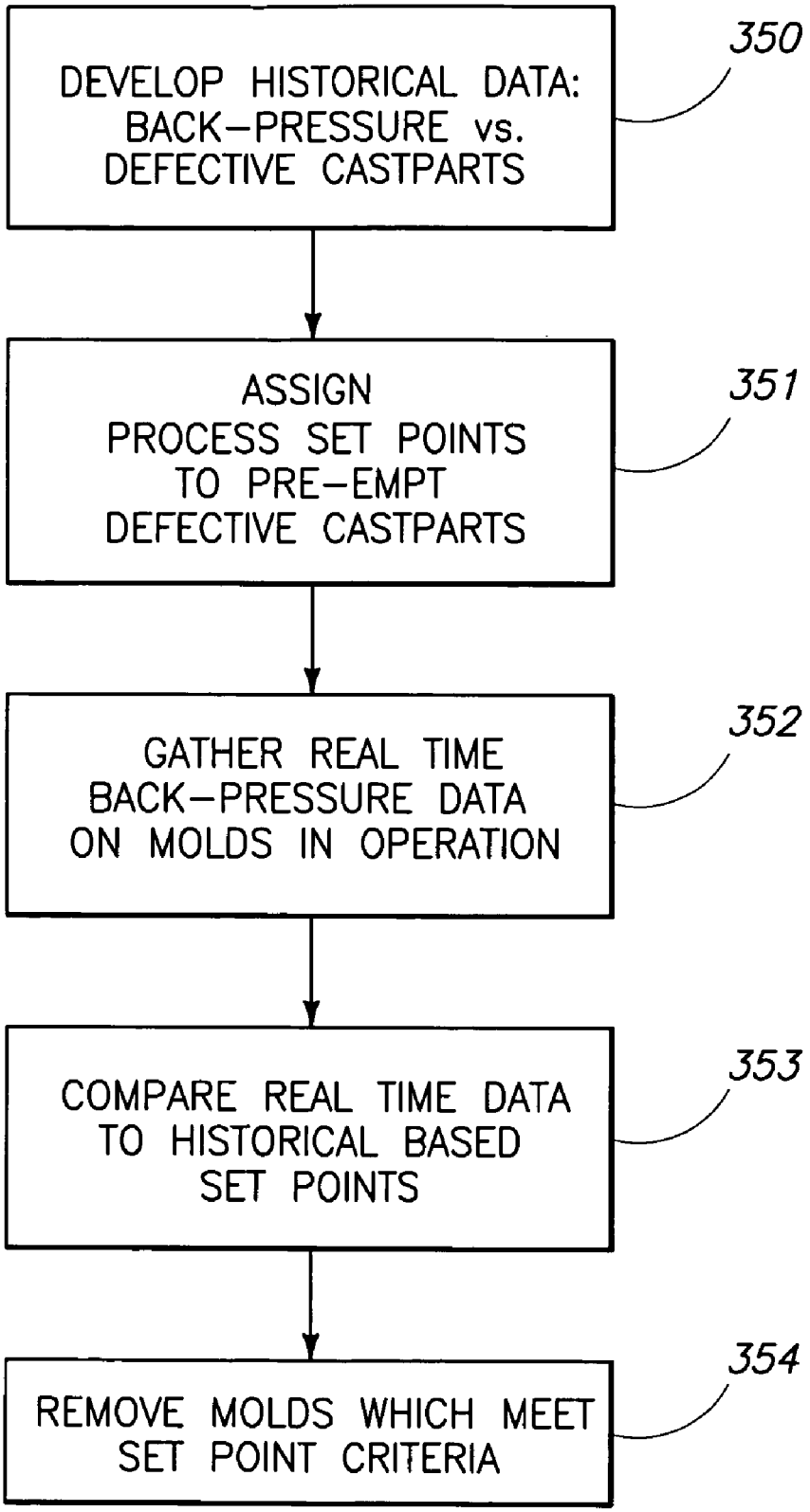
FIG. 14 is a flow chart generally illustrating a process contemplated by embodiments of this invention for using historical data parameters to predict and avoid defective billets.

FIG. 14 is a flow chart generally illustrating a process contemplated by embodiments of this invention for using historical data parameters to predict and avoid defective billets. In step 350, historical data is gathered regarding particular parameters, which are back-pressure, supply pressure, and cast length/time in the embodiment shown. This data can be correlated to establish generally at what points unacceptable castparts are produced. From this data, step 351 involves the setting of set points to pre-empt defective castparts so that a signal or alarm is given before the point is reached wherein defective castparts are produced and must be rejected and scrapped.

In step 352 in FIG. 14, the mass flow or gas flow control system gathers real time data regarding the desired parameters, which for this embodiment as set forth above, may be back-pressure, supply pressure, and cast length/time. From this step 353 involves the comparison of the real time data to the historical based set points, and step 354 completes the process by resulting in the removal of the molds meeting the set point criteria from service. It is believed that this will result in significant economic savings. This general flow may also be used to continually profile and make adjustments in the system, such as the examples shown in the Pressure (PV) versus Cast Length/Time graphs 400 shown in FIG. 15 through FIG. 20 and described below.

Figure 15:
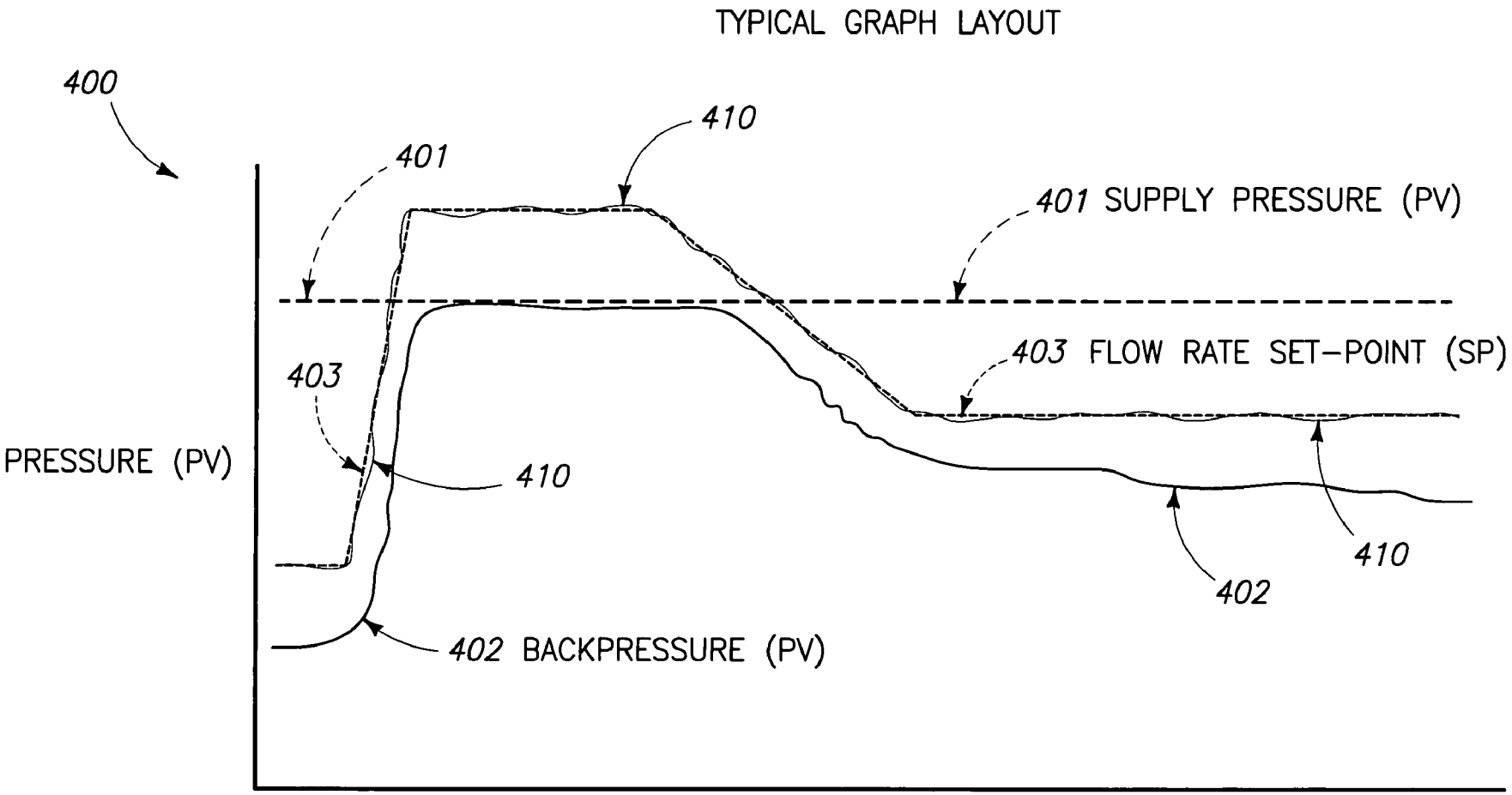
FIG. 15 is a graph showing typical graph layout for historical data trending.
Figure 11:
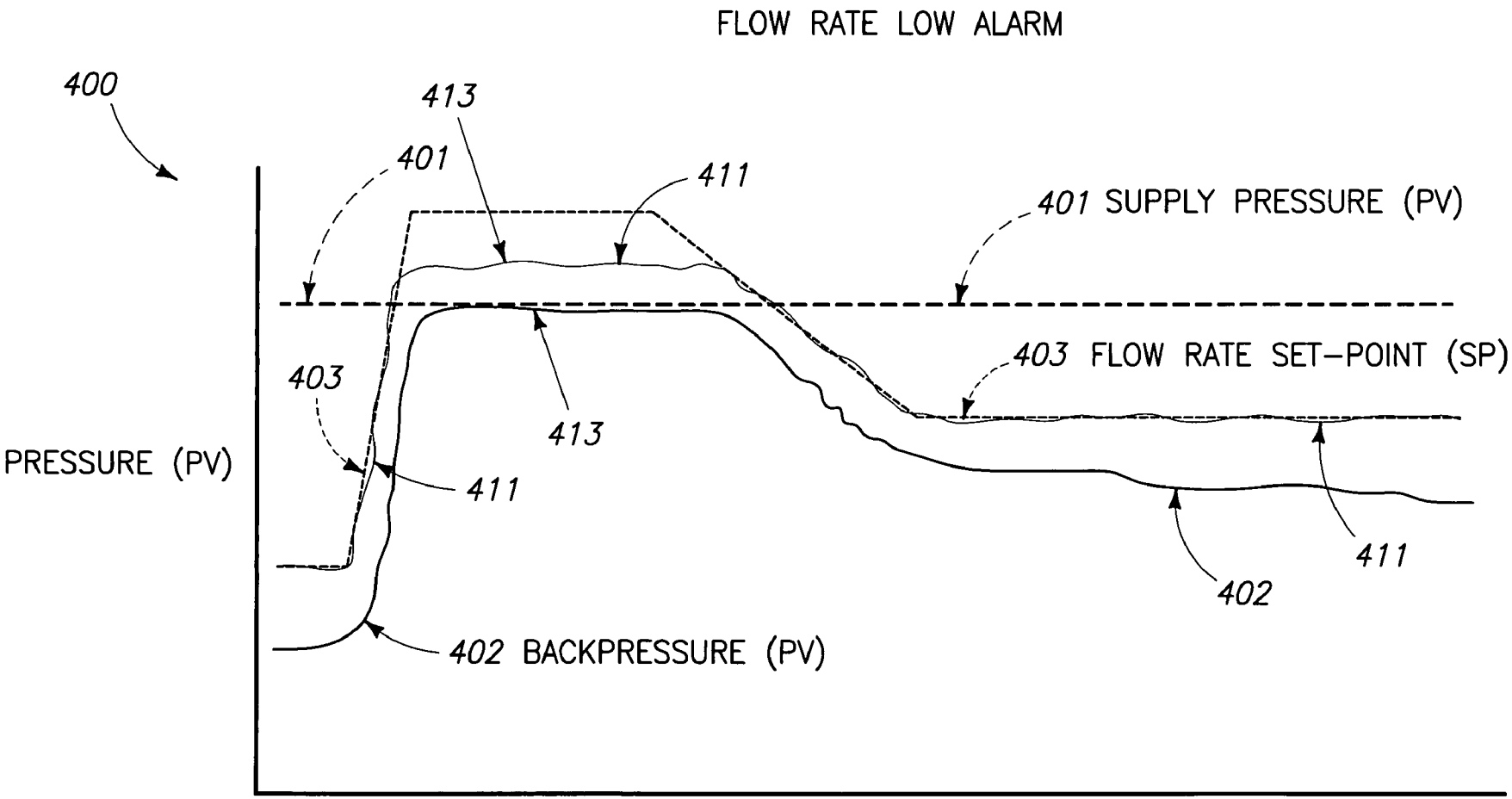
Figure 11:
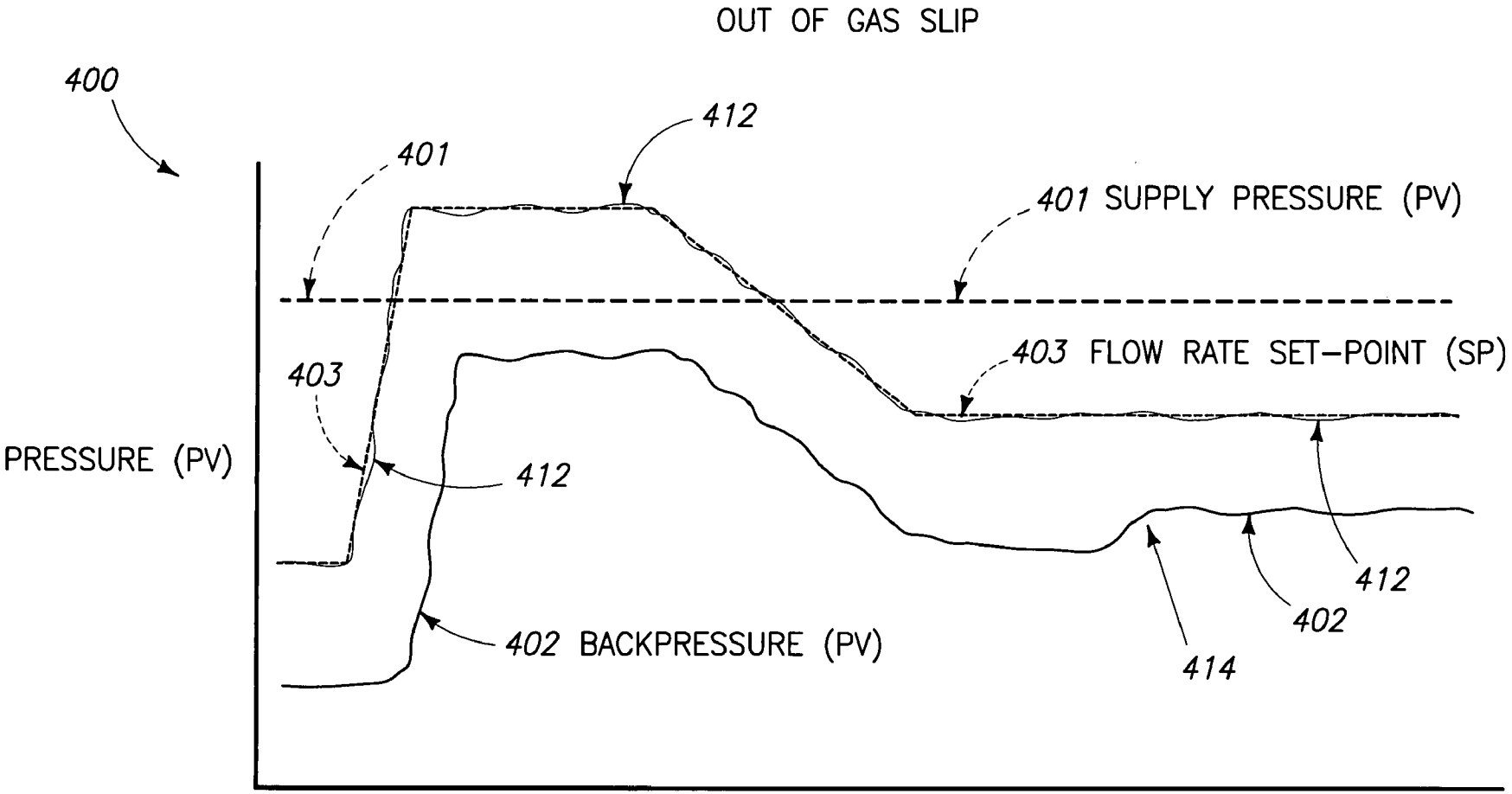

FIG. 15 is a graph showing a correlation of the gas back-pressure upstream from the permeable wall plotted versus the cast length/time. FIG. 15 illustrates gas flow rate (PV), gas "back-pressure" (PV), gas supply pressure (PV) and flow rate set-point (SP).

The recordable data output for such data and process management may therefore include: casting gas supply pressure set-point value (SP); casting gas supply pressure present value (PV); table gas flow rate set-point value (SP); individual mold gas flow rate set-point value (with offset) ("SP"); individual mold gas flow rate present value (PV); and individual mold gas "back-pressure" present value (PV). Alarms which may be desired may include casting gas supply pressure Hi and Low and/or individual mold flow rate Hi and Low values, likely with about a five percent variance or tolerance.

The data generated with the mass flow control system may be used for both process improvement and mold maintenance purposes, wherein an analysis of the historical data may be used to: determine when to change out a mold prior to generating scrap; show the effects to the casting ring or permeable wall when casting without sufficient mass flow of the gas; optimize the casting oil supply rate and other general troubleshooting of the casting process.

Generally the casting recipe gas parameters will be based on gas flow rate in Standard Cubic Feet per Hour ("scfh"), which will depend on mold size and alloy, idle flow (an example of which may be 6 scfh), start flow (an example of which may be 30 scfh), run flow (an example of which may be 10 scfh), and standard gas flow rate ramp profiles based on the cast length.

FIG. 15 shows how the gas flow rate profile 410 generally follows the flow rate set point 403 in this typical historical date layout.

In FIGS. 15-20: the standard gas flow rate ramp profile 403, or the flow rate set-point (SP), is as shown and is based on the cast length/time; the supply pressure (PV) 401 is shown; and an expected back-pressure 402 (such as P3 from FIG. 11) is shown. While FIG. 15 provides a base for FIGS. 16-20 and shows a typical graph layout for historical data trending, no particular graph or configuration is required to practice this invention.

FIG. 16 shows the typical graph layout as illustrated in FIG. 15, with a flow rate profile interposed therein. The items in common with FIG. 15 are described relative to FIG. 15 and will not be repeated herein. FIG. 16 shows that when gas flow rate present value is greater than five percent lower than flow rate offset set-point; the gas back pressure present value near the supply pressure present value; and the mold may not achieve gas slip and should be removed from the mold table.

In FIG. 16, the gas flow rate profile 411 generally follows the gas flow rate set point profile 403 except where it varies by more than five percent near the top of the curve as shown, as indicated by arrows 413.

FIG. 17 shows the typical graph layout as illustrated in FIG. 15, with an out of gas slip condition interposed therein. The items in common with FIG. 15 are described relative to FIG. 15 and will not be repeated herein.

In FIG. 17, the gas flow rate profile 412 generally follows the gas flow rate set point profile 403, however the back-pressure profile 402 is undesirably below the supply pressure, as shown in the graph by arrow 414. The spike or increase in the gas back pressure can be indicative of falling out of gas slip in the mold cavity and the potential varnishing of the permeable wall casting ring.

Figure 18:
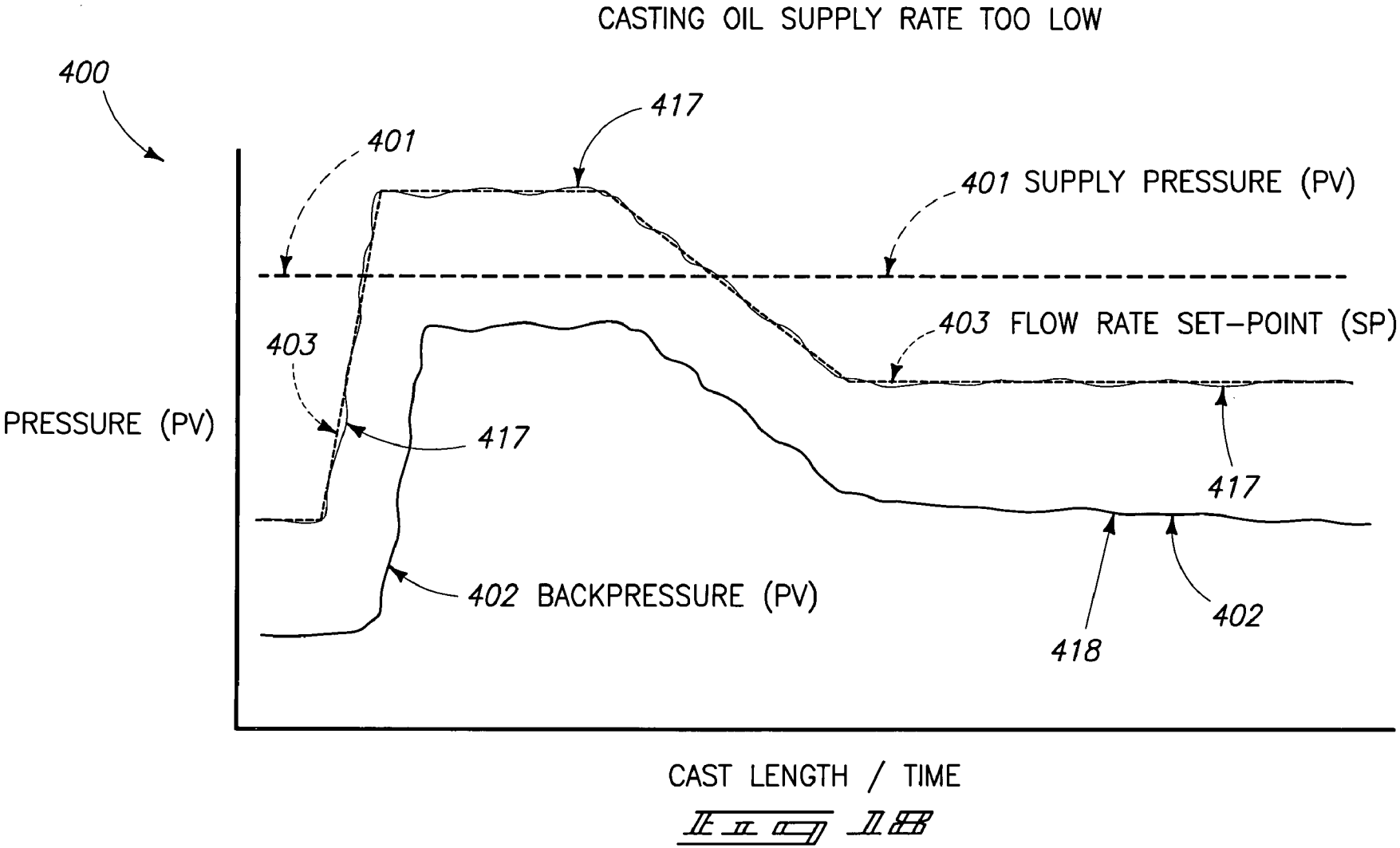
FIG. 18 shows the typical graph layout as illustrated in FIG. 15, with a casting oil supply rate too low interposed therein.
Figure 11:
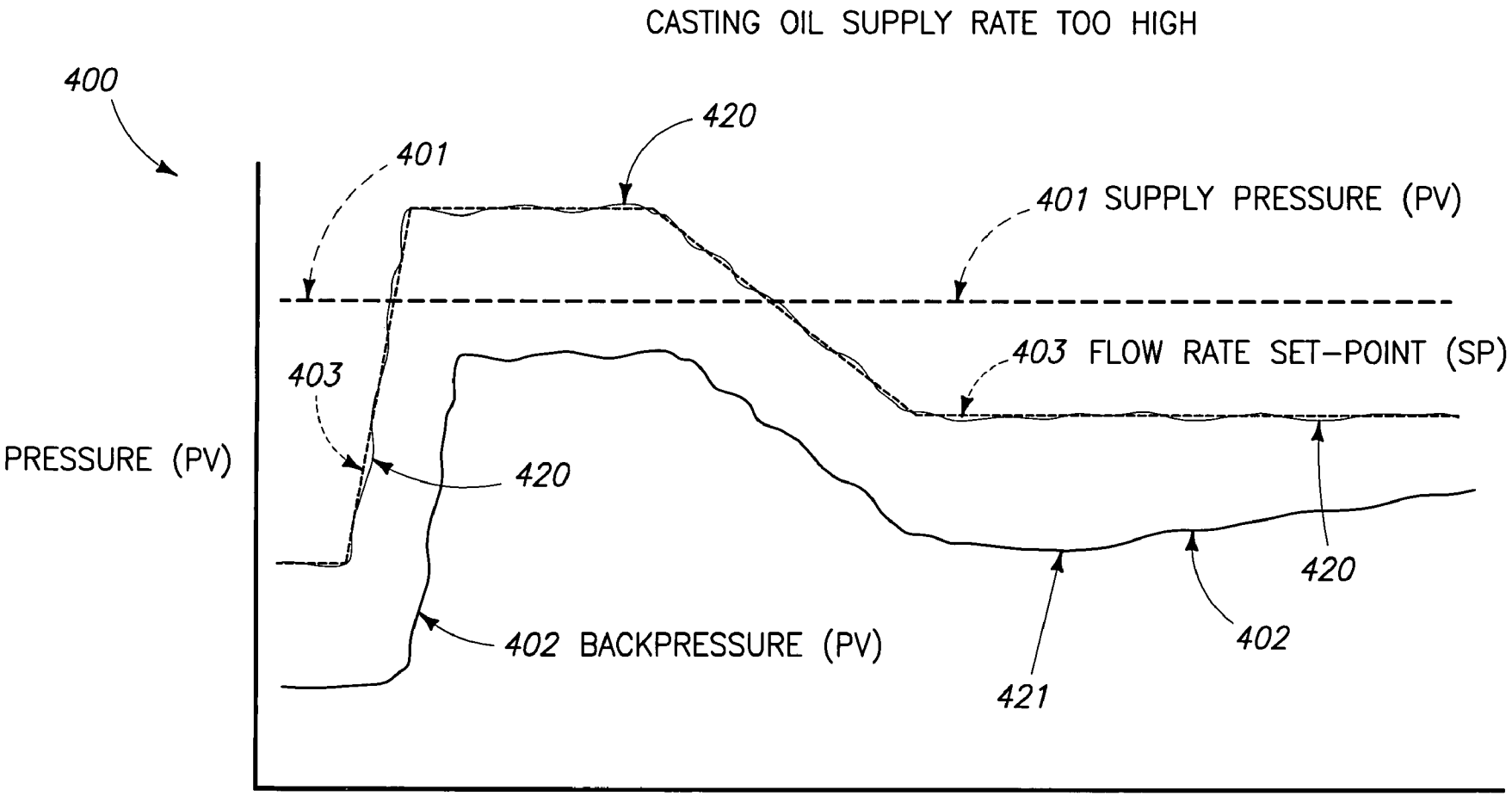

FIG. 18 shows the typical graph layout as illustrated in FIG. 15, with a casting oil supply rate too low interposed therein. The items in common with FIG. 15 are described relative to FIG. 15 and will not be repeated herein.

In FIG. 18, the gas flow rate profile 417 generally follows the gas flow rate set point profile 403, however the slight decrease in the gas back-pressure 402 over the duration of the run/steady state casting condition is shown by arrow 418. This may indicate the permeable wall casting ring is becoming depleted of oil during the cast and the permeability of the graphite is increasing. In this situation, consideration should be given to increasing the oil supply rate to achieve a steady back pressure trend line.

FIG. 19 shows the typical graph layout as illustrated in FIG. 15, with a casting oil supply rate which is too high interposed therein. The items in common with FIG. 15 are described relative to FIG. 15 and will not be repeated herein.

In FIG. 19, the gas flow rate profile 420 generally follows the gas flow rate set point profile 403, however the slight increase in the gas back-pressure 402 over the duration of the run/steady state casting condition is shown by arrow 421. This may tend to indicate the casting ring's oil saturation level is increasing during the cast and the permeability of the graphite is decreasing. The oil supply rate should be decreased to achieve a steady back pressure profile or trend line.

Figure 20:
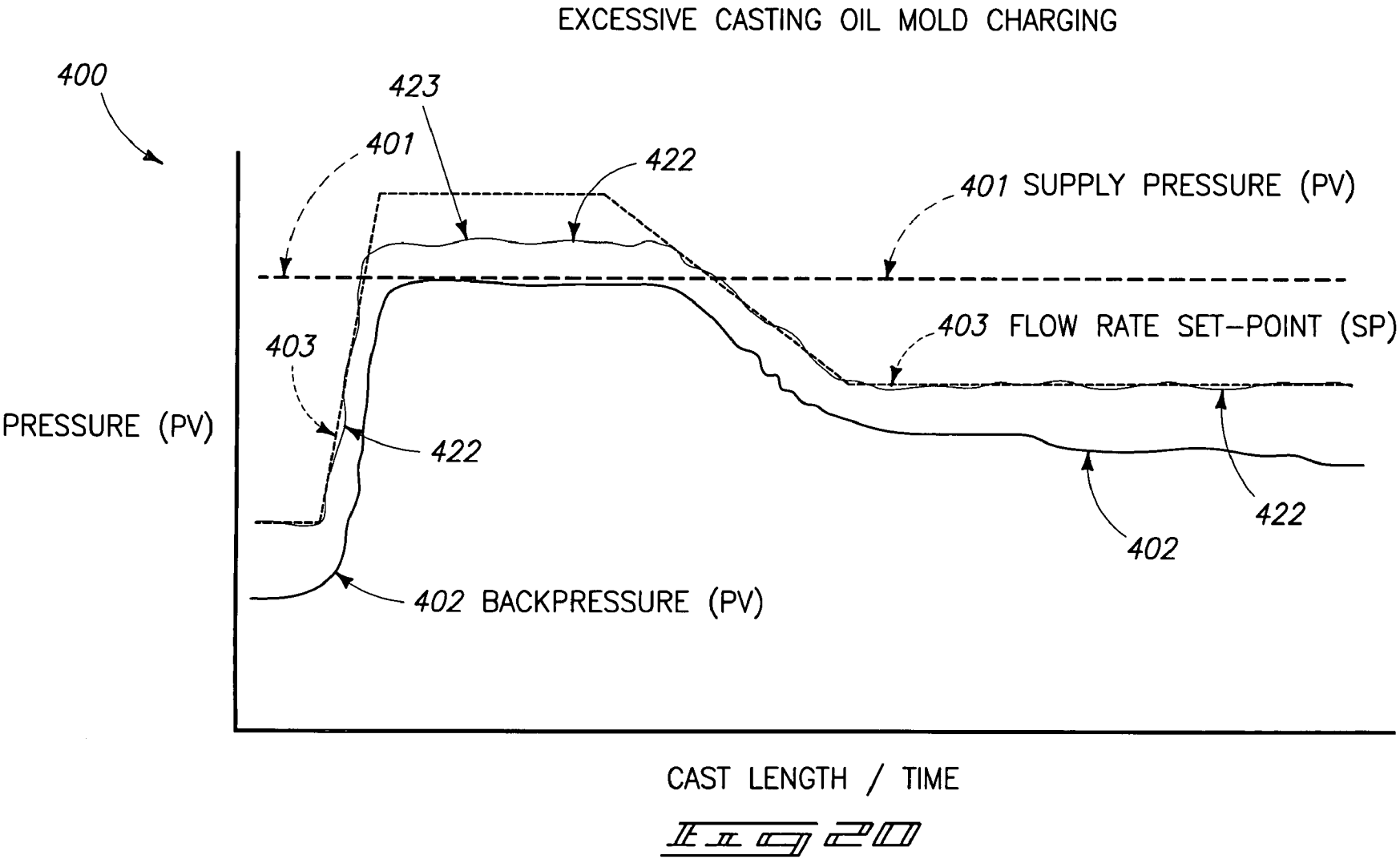
FIG. 20 shows the typical graph layout as illustrated in FIG. 15, with an excessive casting oil mold charging interposed therein.

FIG. 20 shows the typical graph layout as illustrated in FIG. 15, with an excessive casting oil mold charging interposed therein. The items in common with FIG. 15 are described relative to FIG. 15 and will not be repeated herein.

In FIG. 20, the gas flow rate profile 422 as shown at arrow 423, was not able to achieve start flow rate set-point (alarm-low flow) and the gas back pressure will max-out. The gas flow rate may begin to increase during the start phase as the excess oil is being pushed out of the casting ring. The gas back pressure should decrease during the run/steady state casting conditions as the excess oil continuous to be pushed through the permeable wall casting ring.

The examples given relative to FIGS. 16-20 are illustrative for the use that may be made of the data and the additional controls that may be made over the casting process with this invention.

In casting the gas flow rate set-point may be "offset". If a particular mold position requires an increase or decrease in the casting gas flow rate in order to optimize the billet surface, the variance, or "offset" may be stored electronically and applied on each subsequent cast until the set-point variance is cleared and reset. A clearing of the offset may typically occur when a mold is removed from the mold table for service or replacement, and a new mold installed in its place.

This invention may also provide a casting gas flow rate "boost" routine, which provides the ability for the casting operator to temporarily boost the casting gas supply flow rate in order to coax a mold into a casting condition with the gas surrounding the mold outlet. This may be done with a mold fails to enter into this condition at the beginning of a cast or If a mold happens to fall out of it at some point during the cast, and may be as a result of a temporary clog or blockage in the gas flow.

As will be appreciated by those of reasonable skill in the art, there are numerous embodiments to this invention, and variations of elements and components which may be used, all within the scope of this invention.

One embodiment of this invention, for example, is a molten metal casting system comprising: a mold table which includes a mold table framework, a plurality of molds each with a mold cavity with a mold cavity inlet and a mold cavity outlet, and each mold cavity outlet including a permeable perimeter wall through which gas passes during casting; a plurality of gas supply lines, each corresponding to one of the plurality of mold cavities and each configured to provide gas to the permeable perimeter wall of the one of the plurality of mold cavities to which it corresponds; a plurality of gas mass flow controllers operatively connected to the plurality of gas supply lines, with each gas mass flow controller configured to provide a approximately constant mass flow of gas to the permeable perimeter wall of the one of the plurality of mold cavities to which it corresponds; and wherein the plurality of gas mass flow controllers maintain the flow of gas through each of the plurality of permeable perimeter walls approximately equal. In further or more particular embodiments, the system may be further wherein permeable perimeter walls are graphite rings and/or the gas is air.

Further embodiments of the foregoing would be further wherein: each of the plurality of gas mass flow controllers comprises: a pressure gauge positioned upstream of the permeable perimeter wall; a variable pressure valve operatively connected to the one of the plurality of gas supply lines to which it corresponds, the variable pressure valve configured to introduce additional resistance pressure in the gas supply line to achieve a pre-determined gas mass flow rate through the gas supply line. A still further embodiment may be further comprising a programmable logic controller operatively connected to the plurality of gas mass flow controllers and configured to manipulate the variable pressure valve based on pressure readings from the pressure gauge. This embodiment may still further yet be wherein the programmable logic controller is configured to sequentially and separately monitor and control each of the plurality of gas mass flow controllers. The programmable logic controller may also be located remote from the mold table and is operatively connected to the plurality of gas mass flow controllers via communications line.

In another embodiment, a process embodiment, this invention may provide a process in a molten metal casting system for achieving approximately equal gas mass flow to each of a plurality of mold cavities on a mold table, the process comprising: providing a mold table which includes a mold table framework, and a first mold with a mold cavity including a mold inlet and a mold outlet, and a permeable perimeter wall configured to allow gas to pass through during casting; and a second mold with a mold cavity including a mold inlet and a mold outlet, and a permeable perimeter wall configured to allow gas to pass through during casting; a first gas supply line disposed to provide gas flow to the permeable perimeter wall of the first mold, and with a first gas mass flow controller operatively connected the first gas supply line; a second gas supply line disposed to provide gas flow to the permeable perimeter wall of the second mold, and with a second gas mass flow controller operatively connected the second gas supply line; coordinating the first gas mass flow controller with the second gas mass flow controller to set mass flow of gas to the permeable perimeter of the first mold approximately the same as mass flow of gas to the permeable perimeter wall of the second mold.

In yet another process embodiment, this invention may provide a process in a molten metal casting system for maintaining a mass flow of gas to a mold with a mold cavity including a mold inlet and a mold outlet, and a permeable perimeter wall configured to allow gas to pass through during casting, the process comprising: providing a gas supply line disposed to provide gas flow to the permeable perimeter wall of the mold; and a gas mass flow controller operatively connected the gas supply line, the gas mass flow controller comprising a pressure gauge upstream of the permeable perimeter wall and a variable pressure valve, wherein the variable pressure valve is configured to variably supplement pressure from the permeable perimeter wall to maintain an approximately constant mass flow of gas through the permeable perimeter wall of the mold.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A molten metal casting system comprising:

a mold table which includes a mold table framework, a plurality of molds each with a mold cavity with a mold cavity inlet and a mold cavity outlet, and each mold cavity outlet including a permeable perimeter wall through which gas passes during casting;

a plurality of gas supply lines, each corresponding to one of the plurality of mold cavities and each configured to provide gas to the permeable perimeter wall of the one of the plurality of mold cavities to which it corresponds;

a plurality of gas mass flow controllers operatively connected to the plurality of gas supply lines, with each gas mass flow controller configured to provide an ongoing approximately constant mass flow of gas to the permeable perimeter wall of the one of the plurality of mold cavities to which it corresponds; and wherein the plurality of gas mass flow controllers maintain the flow of gas through each of the plurality of permeable perimeter walls approximately equal as the resistance to the flow of gas through each of the plurality of permeable perimeter walls varies during casting.

2. A molten metal casting system as recited in claim 1, and further wherein the permeable perimeter walls are graphite rings.

3. A molten metal casting system as recited in claim 1, and further wherein the gas is air.

4. A molten metal casting system as recited in claim 1, and wherein each of the plurality of gas mass flow controllers comprises:

a pressure gauge positioned upstream of the permeable perimeter wall;

a variable pressure valve operatively connected to the one of the plurality of gas supply lines to which it corresponds, the variable pressure valve configured to introduce additional resistance pressure in the gas supply line to achieve a pre-determined gas mass flow rate through the gas supply line.

5. A molten metal casting system as recited in claim 4, and further comprising a programmable logic controller operatively connected to the plurality of gas mass flow controllers and configured to manipulate the variable pressure valve based on pressure readings from the pressure gauge.

6. A molten metal casting system as recited in claim 5, and further wherein the programmable logic controller is configured to sequentially and separately monitor and control each of the plurality of gas mass flow controllers.

7. A molten metal casting system as recited in claim 5, and further wherein the programmable logic controller is located remote from the mold table and is operatively connected to the plurality of gas mass flow controllers via communications line.

8. A molten metal casting system as recited in claim 1, and further wherein the time over which the approximately constant mass flow of gas is provided to the permeable perimeter wall is one of the time of a cast and the useful life of the permeable perimeter wall.

9. A molten metal casting system as recited in claim 1, and further comprising a proportional valve in each of the plurality of gas supply lines, wherein the mass flow controller controls the proportional valve to introduce variable resistance in the desired ones of the plurality of gas supply lines in order to provide the approximately constant mass flow of gas to the permeable perimeter wall.

10. A process in a molten metal casting system for achieving approximately equal gas mass flow to each of a plurality of mold cavities on a mold table, the process comprising:

providing a mold table which includes a mold table framework, and a first mold with a mold cavity including a mold inlet and a mold outlet, and a permeable perimeter wall configured to allow gas to pass through during casting; and a second mold with a mold cavity including a mold inlet and a mold outlet, and a permeable perimeter wall configured to allow gas to pass through during casting;

a first gas supply line disposed to provide gas flow to the permeable perimeter wall of the first mold, and with a first gas mass flow controller operatively connected the first gas supply line;

a second gas supply line disposed to provide gas flow to the permeable perimeter wall of the second mold, and with a second gas mass flow controller operatively connected the second gas supply line;

coordinating the first gas mass flow controller with the second gas mass flow controller to set mass flow of gas to the permeable perimeter of the first mold approximately the same as mass flow of gas to the permeable perimeter wall of the second mold during casting.

11. A process in a molten metal casting system for maintaining a mass flow of gas to a mold with a mold cavity including a mold inlet and a mold outlet, and a permeable perimeter wall configured to allow gas to pass through during casting, the process comprising:

providing a gas supply line disposed to provide gas flow to the permeable perimeter wall of the mold; and a gas mass flow controller operatively connected the gas supply line, the gas mass flow controller comprising a pressure gauge upstream of the permeable perimeter wall and a variable pressure valve, wherein the variable pressure valve is configured to variably supplement pressure from the permeable perimeter wall to maintain an approximately constant mass flow of gas through the permeable perimeter wall of the mold as the resistance to the flow of gas through each of the plurality of permeable perimeter walls varies during casting.

12. A process in a molten metal casting system as recited in claim 11, and further wherein the mass flow controller is configured to variably supplement pressure approximately equal to a combination of back pressure from the permeable perimeter wall and the variable pressure valve.

* * * * *